US009234480B2

(12) United States Patent
Gayton

(10) Patent No.: US 9,234,480 B2
(45) Date of Patent: Jan. 12, 2016

(54) ISOTHERMAL MACHINES, SYSTEMS AND METHODS

(71) Applicant: KAIRAMA INC., Vancouver (CA)

(72) Inventor: Donald Gayton, West Vancouver (CA)

( * ) Notice: Subject to any disclaimer, the term of this patent is extended or adjusted under 35 U.S.C. 154(b) by 243 days.

(21) Appl. No.: 13/935,536

(22) Filed: Jul. 4, 2013

(65) Prior Publication Data

US 2014/0007569 A1 Jan. 9, 2014

Related U.S. Application Data

(60) Provisional application No. 61/668,025, filed on Jul. 4, 2012.

(51) Int. Cl.

| | |
|---|---|
| ***F01B 29/00*** | (2006.01) |
| ***F01B 29/10*** | (2006.01) |
| ***F02G 1/055*** | (2006.01) |
| ***F01B 17/02*** | (2006.01) |
| ***F02G 1/02*** | (2006.01) |
| ***F04B 39/06*** | (2006.01) |
| ***F04B 53/08*** | (2006.01) |
| ***F01K 13/00*** | (2006.01) |
| ***F28F 5/00*** | (2006.01) |
| ***F28D 7/02*** | (2006.01) |
| ***F28F 1/02*** | (2006.01) |

(52) U.S. Cl.

CPC ..... *F02G 1/055* (2013.01); *F01B 17/02* (2013.01); *F01K 13/00* (2013.01); *F02G 1/02* (2013.01); *F04B 39/06* (2013.01); *F04B 53/08* (2013.01); *F28D 7/024* (2013.01); *F28F 1/022* (2013.01); *F28F 5/00* (2013.01)

(58) Field of Classification Search

CPC ..... F02G 1/055; F02G 1/02; F28F 1/022; F28F 5/00; F28D 7/024; F01K 13/00; F04B 53/08; F04B 39/06; F01B 17/02

USPC ..... 60/508–526, 530–531; 417/559, 207, 417/53

See application file for complete search history.

(56) References Cited

U.S. PATENT DOCUMENTS

| | | | | |
|---|---|---|---|---|
| 689,702 | A | 12/1901 | Berg | |
| 836,624 | A | 11/1906 | Berg | |
| 1,181,802 | A * | 5/1916 | Rogge | 123/193.1 |
| 1,566,442 | A | 12/1925 | Stancliffe | |
| 1,681,280 | A | 8/1928 | Bruckner | |
| 1,929,350 | A | 10/1933 | Christensen | |

(Continued)

FOREIGN PATENT DOCUMENTS

| | | |
|---|---|---|
| EP | 1957796 B1 | 6/2010 |
| GB | 478072 | 1/1938 |

(Continued)

*Primary Examiner* — Hoang Nguyen

(74) *Attorney, Agent, or Firm* — Oyen Wiggs Green & Mutala LLP

(57) ABSTRACT

A compressor or expander has a variable-volume chamber with a heat exchanger located inside the chamber. The heat exchanger can have a helical structure and may be connected between walls of the chamber that move relative to one another during compression or expansion. The heat exchanger comprises a passage containing a heat exchange fluid. The heat exchange fluid may add heat to or remove heat from a gas being expanded or compressed. Embodiments may provide isothermal or near isothermal compression or expansion.

50 Claims, 17 Drawing Sheets

(56) References Cited

U.S. PATENT DOCUMENTS

| | | | | |
|---|---|---|---|---|
| 2,328,439 | A | 8/1943 | Esnault-Pelterie | |
| 3,118,285 | A | 1/1964 | Malaker et al. | |
| 3,200,582 | A | 8/1965 | Dros | |
| 3,928,974 | A | 12/1975 | Benson | |
| 4,242,878 | A | 1/1981 | Brinkerhoff | |
| 4,268,042 | A | 5/1981 | Borlan | |
| 4,271,669 | A | 6/1981 | Keller et al. | |
| 4,285,197 | A | 8/1981 | Cloup | |
| 4,428,197 | A * | 1/1984 | Liljequist | 60/525 |
| 4,442,670 | A * | 4/1984 | Goldman | 60/517 |
| 4,446,698 | A | 5/1984 | Benson | |
| 4,490,974 | A | 1/1985 | Colgate | |
| 4,622,813 | A | 11/1986 | Mitchell | |
| 4,676,067 | A | 6/1987 | Pinto | |
| 4,779,420 | A | 10/1988 | Sieck | |
| 5,193,991 | A | 3/1993 | Koebler et al. | |
| 5,394,709 | A | 3/1995 | Lorentzen | |
| 5,839,270 | A | 11/1998 | Jirnov et al. | |
| 6,131,644 | A | 10/2000 | Kohara et al. | |
| 8,141,381 | B2 | 3/2012 | Ino et al. | |
| 2006/0248886 | A1 | 11/2006 | Ma | |
| 2009/0249778 | A1 | 10/2009 | Corbett, Jr. | |
| 2009/0260361 | A1 | 10/2009 | Prueitt | |
| 2010/0263405 | A1 | 10/2010 | Durand et al. | |
| 2010/0287936 | A1 | 11/2010 | Klutchenko | |
| 2011/0167813 | A1 | 7/2011 | McBride et al. | |
| 2011/0232281 | A1 | 9/2011 | McBride et al. | |
| 2014/0007569 | A1 * | 1/2014 | Gayton | 60/508 |

FOREIGN PATENT DOCUMENTS

| | | | |
|---|---|---|---|
| GB | 2002457 | A | 2/1979 |
| GB | 2014668 | | 8/1979 |
| WO | 2010037980 | A1 | 4/2010 |
| WO | 2010115112 | A1 | 10/2010 |
| WO | 2011101882 | A1 | 5/2011 |
| WO | 2011079271 | A2 | 6/2011 |

* cited by examiner

ISOTHERMAL MACHINES, SYSTEMS AND METHODS

REFERENCE TO RELATED APPLICATION

This application claims the benefit under 35 U.S.C. §119 of U.S. application No. 61/668,025 filed 4 Jul. 2012 and entitled ISOTHERMAL MACHINES, SYSTEMS AND METHODS which is hereby incorporated herein by reference for all purposes.

TECHNICAL FIELD

This invention relates to compressors, engines and systems that include compressors and/or engines. Specific embodiments provide compressors that operate under isothermal or near-isothermal compression cycles.

BACKGROUND

Gases are compressed for a wide range of applications. For example, compressed gases may be used to store energy, run tools or other pneumatic equipment, provide compact storage of gases, provide conditions to promote chemical reactions and the like. Refrigeration systems and heat pumps also typically include compressors for compressing gases. As air (or any other gas) is compressed, work is being done on the gas. Conservation of energy dictates the energy from the work cannot be lost. In adiabatic compression (adiabatic means there is no heat flow in or out of the system) a significant proportion of the energy from the work done to compress the gas goes into increasing the gas temperature. The end result is hot, compressed gas. Most current technologies for gas compression perform compression that is adiabatic or nearly so.

Many gases behave to a good approximation as ideal gases which obey the ideal gas law:

$$PV=nRT \tag{1}$$

where P is pressure, V is volume, n is the number of molecules of gas, R is a constant and T is the temperature. When a gas is compressed under adiabatic conditions (no heat flows into or out of the gas during compression) the entropy of the gas remains constant. Therefore, for an ideal gas under adiabatic compression $PV^{\gamma}$ is constant, where $\gamma$ is the heat capacity ratio for the gas and so, for an ideal gas, $T \propto 1/V^{(\gamma-1)}$, $\gamma$ generally has a value in excess of 1 so that a decrease in volume, as occurs when a gas is compressed, results in a corresponding increase in the gas temperature. For dry air, $\gamma$ has a value of about 1.4.

The heating which results from adiabatic compression can lead to inefficiencies because hot compressed gas typically loses heat to its environment. Where a gas is compressed adiabatically, allowed to cool to ambient temperature and subsequently allowed to expand to do work the amount of energy taken to compress the gas is typically about twice the amount of work done. Consequently the overall efficiency of such a round trip compression expansion is only about 50%.

Various attempts have been made to provide compressors that operate on an isothermal cycle. In isothermal compression, the gas being compressed is cooled as it is compressed so that the temperature of the gas remains essentially constant. Such systems have not been widely adopted.

BRIEF DESCRIPTION OF THE DRAWINGS

The accompanying drawings illustrate non-limiting example embodiments of the invention.

DESCRIPTION

Figure 1:
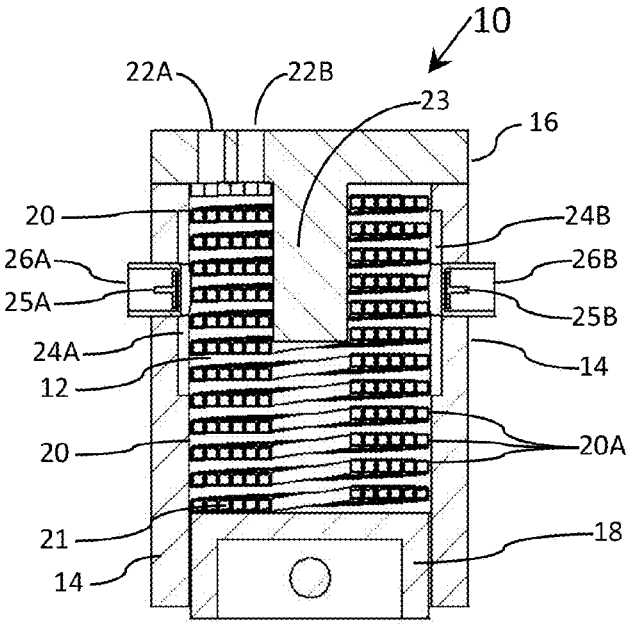
FIG. 1 is a cross sectional view of a compressor according to an example embodiment.

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

One aspect of this invention provides compressors that can operate on an isothermal or near isothermal cycle. In some embodiments the compressors can compress air or other gases such that a temperature of compressed gas exiting the compressor is within ±10° C. or ±25° C. or ±40° C. of the gas temperature prior to compression. In an example embodiment a compressor comprises a variable-volume chamber within which gas can be compressed. The variable-volume chamber may, for example, be defined by a piston reciprocating within a cylinder. A heat-sink is provided within the variable-volume chamber. The heat sink has internal passages that contain a fluidic heat transfer medium. The heat sink is operable to remove heat from the gas being compressed to reduce heating of the gas during compression. Heat energy removed from the gas being compressed may be harnessed in various ways as described below. The heat sink is itself deformable so that it can expand and contract to fill the variable-volume chamber during the compression and yet allows the volume of the chamber to be reduced to effect compression of the gas contained within the chamber.

Another aspect of the invention provides machines that include heat exchangers located inside variable-volume chambers that may be used for one or both of compressing a gas or expanding a gas. The heat exchangers may be applied to add heat to the gas being compressed or expanded or to remove heat from the gas being compressed or expanded.

In an example embodiment the heat exchanger is provided by a ribbon of a heat conducting material coiled to provide a flat helical spiral having an outer diameter slightly smaller than the diameter of the cylinder in which it is located. Passages for the flow of a heat conducting fluid extend through the ribbon. The heat exchanger may be connected between two walls of the chamber that move relative to one another as the volume of the chamber changes. For example, the heat exchanger may have one end connected to a cylinder head and another end connected to a piston such that the coils of the heat exchanger are alternately pulled apart and compressed together as the piston reciprocates. Such a heat exchanger is an example of a heat exchanger that can be constructed to provide heat exchange surfaces that are more or less uniformly spaced apart throughout the chamber at all stages of the compression cycle.

In some embodiments the heat exchanger has a natural length longer than a distance between the cylinder head and the piston. In such embodiments the heat exchanger maybe compressed to fit between the cylinder head and piston such that the heat exchanger exerts forces against the cylinder head and piston. These forces may assist in maintaining attachment of the heat exchanger to the cylinder head and piston.

The heat exchanger may be dimensioned such that, when the piston is at top dead center (i.e. when the compression chamber has minimum volume) adjacent turns of the heat exchanger are touching or nearly touching. For example, adjacent turns of the heat exchanger may be spaced part by less than ½ mm (e.g. 0.1 mm or so) or even touching when the piston is at top dead center. This reduces dead volume in the chamber.

It is desirable to reduce dead volume (i.e. the volume available for gas to fill when the chamber has its smallest volume—e.g. when the piston is at top-dead-center) because the maximum pressure that can be achieved by a compressor is reduced as the dead volume increases. In some embodiments the dead volume is less than 10% or less than 5% of the maximum volume of the chamber. In some embodiments a compression ratio provided by operation of the piston is at least 10:1 or 20:1. Dead volume reduces the flow of compressed gas obtainable at a given pressure. For example, if the dead volume is 5%, and desired compression is 10:1, so compressed gas starts to flow out when the gas is compressed to 10% of its initial volume (assuming isothermal compression) then only ½ of the high pressure gas will be expelled before the piston starts the next intake stroke. Ideally dead volume would be 0%, causing all the high pressure gas to be expelled at top dead center. While this ideal is not achievable in practice it can be approached.

As the piston travels away from the head during the intake stroke, the spaces between adjacent turns of the heat exchanger open up evenly to receive incoming gas. The incoming gas is exposed to the entire surface area of the heat exchanger. When the piston reaches the bottom of its travel, the gap between adjacent turns of the heat exchanger is maximum (for example, on the order of 3 mm or so). The gas to be compressed fills all the space in the chamber surrounding the heat exchanger. The surface area of the heat exchanger may readily be made to be 15 to 30 or more times larger than the surface area of the outside surfaces of the chamber.

Preferably, when the heat exchanger is fully extended (i.e. when the piston is at bottom-dead-center) the maximum space between surfaces of adjacent turns of the heat exchanger is no more than about 3 mm. This ensures that all gas molecules between the turns of the heat exchanger are no more that 1½ mm away from a surface of the heat exchanger.

As the piston reverses its motion and travels back toward the head to compress the gas in the chamber, the coils of the heat exchanger are evenly compressed toward one another. As the gas heats up due to the compression the gas gives up its heat to the heat exchanger coils, thus limiting the temperature rise of the gas. Near the top of the piston's travel the gas is highly compressed and allowed to exit the chamber.

Figure 1A:
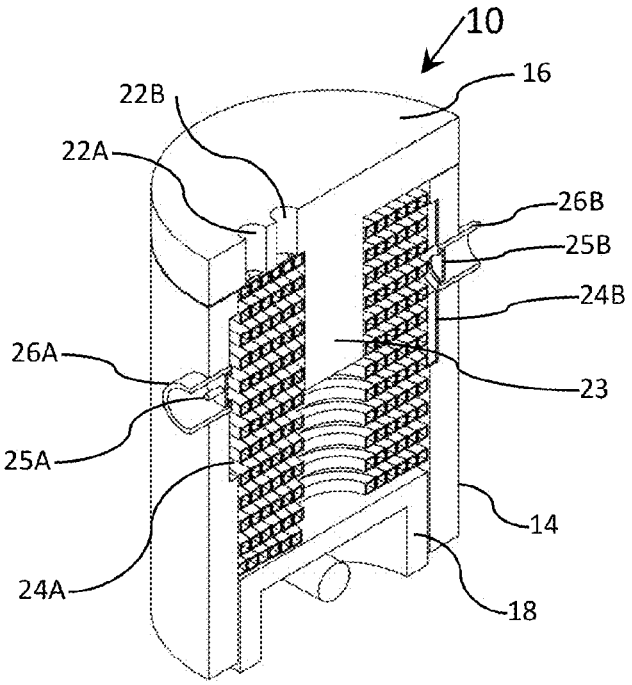
FIG. 1A is a cut away view of the compressor of FIG. 1.

FIG. 1 is a cross sectional view of a compressor 10 according to an example embodiment. FIG. 1A is a cut away view of compressor 10. Compressor 10 comprises a variable-volume chamber 12 defined in a cylinder 14 between a cylinder head 16 and a piston 18. Piston 18 is driven to reciprocate by a mechanism (not shown in FIG. 1). For example, piston 18 may be driven to reciprocate by a rotating crankshaft coupled to piston 18 by a connecting rod. Any other suitable reciprocation mechanism may be provided to drive reciprocation of piston 18. For example, piston 18 may be driven to reciprocate by a linear actuator, a swash plate, a rocker arm or the like.

Figure 1B:
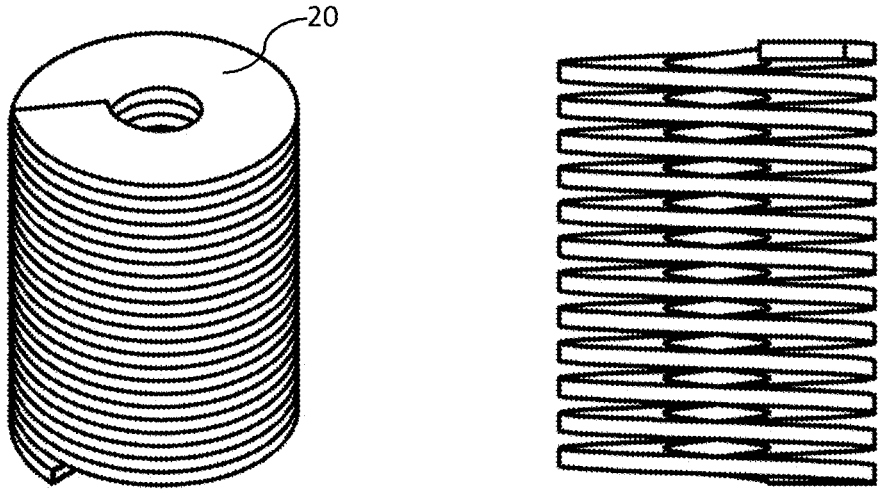
FIGS. 1B and 1C show example extensible helical heat exchangers.
Figure 1C:
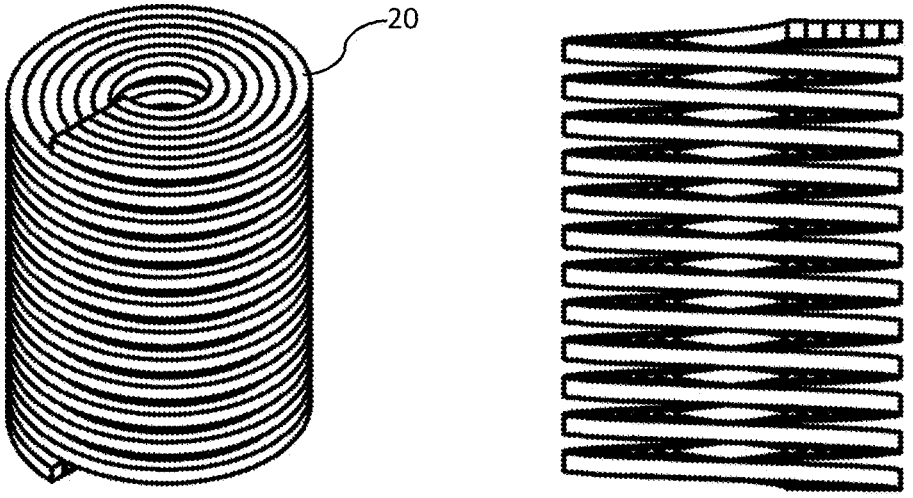

Heat exchanger 20 is disposed inside chamber 12. Heat exchanger 20 comprises a helical coil. FIGS. 1B and 1C show example heat exchangers 20. The turns 20A of heat exchanger 20 are flat. Passages 21 within heat exchanger 20 carry a heat exchange fluid. While multiple parallel passages 21 are shown in FIG. 1, some alternative embodiments have a single passage 21. Passages 21 may have various shapes, for example, square, rectangular, round, oval, etc. Passages 21 may optionally have texturing on their walls to enhance heat transfer into the heat exchange fluid contained in passages 21. The texturing could be micro-scale texturing or macro-scale texturing to prevent laminar flow thus increasing heat transfer.

Heat exchanger 20 has a cylindrical inner diameter and a cylindrical outer diameter. In some embodiments the ratio of the inner diameter to the outer diameter is approximately 1:3.

In some embodiments, the terminal portions of heat exchanger 20 are formed so that their radius of curvature is slightly smaller than the rest of heat exchanger 20 or, in the alternative, the ribbon of material forming heat exchanger 20 is slightly narrower in the terminal portions of heat exchanger 20. This ensures that the end portions of heat exchanger 20 are slightly spaced apart inwardly from the walls of cylinder 14.

The heat exchange fluid may, for example, comprise: water, oil, ethylene glycol, propylene glycol, an aqueous or non-aqueous coolant liquid or a gas coolant. Viscosity of the coolant is preferably low to reduce the energy required to move the coolant through the heat exchanger. The coolant preferably has a high heat capacity. In some embodiments the combination of heat capacity and coolant flow results in a temperature rise of the coolant between an inlet into the heat exchanger to an outlet of the heat exchanger of less than 5° C. For example, in a 1.5 HP (1500 W) compressor, the fluid will be required to carry away 1500 W of heat. If water (heat capacity=4.2 J/g° C.) is used as the coolant then maintaining a temperature rise of less than 5° C. while carrying off 1500 W of heat requires a flow of at least 71 g/s. In certain applications it may be desirable to select a coolant that will not boil inside the heat exchanger. Boiling of the coolant may be acceptable in other applications.

In some embodiments the heat exchange fluid is initially at or near ambient temperature (for example as a result of passing through a radiator). In other embodiments the heat exchange fluid is chilled or heated before being supplied to heat exchanger 20.

In some embodiments the flow of heat exchange fluid is variable and is controlled based on one or more of: a temperature of fluid exiting a compressor or expander; a temperature of fluid entering a compressor or expander; a temperature difference between fluid entering a compressor or expander and fluid exiting the compressor or expander; a temperature of an element within a compressor or expander; a temperature of heat exchange fluid entering a heat exchanger 20, a temperature of heat exchange fluid leaving a heat exchanger 20 a temperature of a part of heat exchanger 20. For example, a valve, variable volume pump or the like may be electronically controlled to regulate the flow of heat exchange fluid by a controller connected to receive signals from one or more temperature sensors. The temperature sensors may be situated to sense temperatures of one or more of: fluid entering a compressor or expander; fluid leaving the compressor or expander; heat exchange fluid entering a heat exchanger 20, heat exchange fluid leaving a heat exchanger 20, a component inside a chamber of a compressor or expander, a portion of a heat exchanger 20 or the like. The controller may adjust the flow of heat exchange fluid to maintain desired operation of the compressor or expander.

In some embodiments the heat exchange fluid is pressurized to a pressure that is similar to a maximum pressure expected within chamber 12. Maintaining a reasonably high pressure of heat exchange fluid can help to prevent passages 21 from collapsing as a result of high gas pressures in cylinder 12 while permitting passages 21 to have thin walls so as to provide good thermal contact between gas in cylinder 12 and heat exchange fluid in passages 21. One advantage of the use of a liquid as the heat exchange fluid is that liquids are essentially incompressible. Thus, as the pressure changes in chamber 12 a liquid in passages 21 may better support thin walls of heat exchanger 20 against flexing which could lead to fatigue and possible failure of heat exchanger 20.

Heat exchanger 20 is made of a suitable resilient thermally-conductive material. For example, heat exchanger 20 may be made of a metal such as brass, aluminum, steel, stainless steel, or copper, a thermally-conductive plastic, carbon fibre, glass fibre, acrylic plastic.

In the illustrated embodiment, passages 21 are connected such that heat exchange fluid both enters and leaves heat exchanger 20 at one end. For example, heat exchange fluid may enter heat exchange 20 from a passage 22A in head 16, flow along heat exchanger 20 toward piston 18 by way of one or more passages 21, flow into other connected passage(s) 21 near a second end of heat exchange 20 near piston 18 and return through heat exchanger 20 to another passage 22B in head 16. In this embodiments, two or more passages 21 are interconnected so that heat exchange fluid can pass in one direction along heat exchanger 20 through one passage 21 and then travel in the reverse direction along another one of passages 21.

Figure 1D:
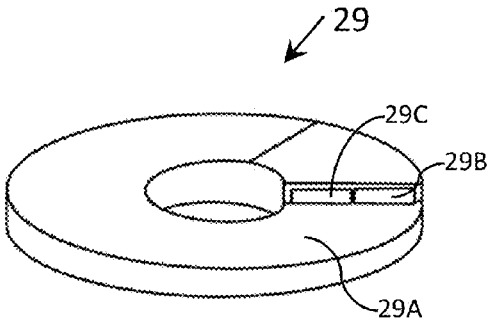
FIGS. 1D and 1E are details showing an example connection that may be used to anchor a heat exchanger and to supply heat exchange fluid to an in-cylinder heat exchanger.
Figure 1E:
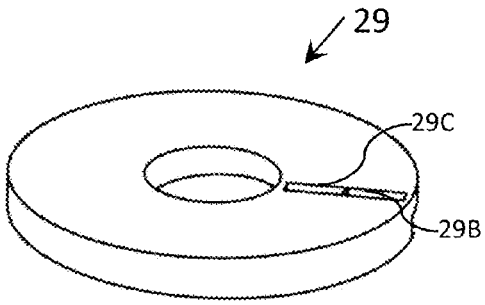

Compressor 10 of FIG. 1 includes a heat exchange fluid inlet passage 22A connected to supply heat exchange fluid to heat exchanger 20 and a heat exchange fluid outlet passage 22B connected to receive heat exchange fluid that has been circulated through passages of heat exchanger 20. FIGS. 1D and 1E are details showing one example connection that may be made between a heat exchanger 20 and a cylinder head or piston. Such a connection may be formed in a cylinder head or piston or attached to a cylinder head or piston. Connection 29 comprises a helical ramp portion 29A and passages 29B and 29C for carrying coolant fluid from passages 22A and 22B in a head into passages 21 within heat exchanger 20. One end of a helical ribbon heat exchanger 20 attaches to the helical ramp portion 29A with coolant passages 21 in communication with passages 29B and 29C.

Heat exchanger 20 may be attached to connection 29 by soldering, brazing or the like. For example, heat exchange 20 may be attached to connection 29 using a solder reflow technique in which solder paste is applied to the heat exchanger, the heat exchanger is clamped in position against connector 29 and the assembly is heated to reflow the solder which will wick into the mating surfaces to form a fluid-tight connection and hold the heat exchanger in place.

Figure 1F:
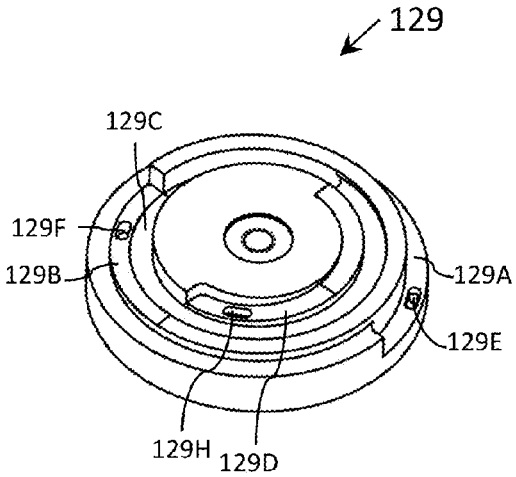
FIGS. 1F and 1G show an alternative mounting for a heat exchanger.
Figure 1G:
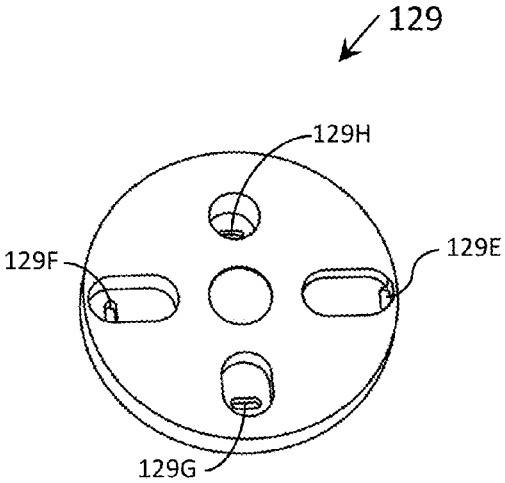

FIGS. 1F and 1G show an alternative connection 129 for a heat exchanger that provides attachment for the heat exchanger at four points that are spaced apart around the connection 129. Providing such circumferentially spaced apart support points helps to prevent bowing of the heat exchanger that could otherwise result from the mechanical forces of compression acting off-center on the heat exchanger. Connection 129 has helical ramp portions 129A, 129B, 129C and 129D. For attachment to connection 129 an end portion of the helical ribbon making up the heat exchanger 20 is divided into a plurality of strips, one strip for each ramp portion. In this example there are four strips. The strips are of different lengths. Each strip is attached to a corresponding one of the ramp portions. Each strip may contain a passage 21. There are a number of alternative ways to connect passages 21 to corresponding passages 129E, 129F, 129G and 129H through which fluid may flow into and/or out of heat exchanger 20. One approach is to plug the ends of passages 21 and to make openings (e.g. slots or holes) in the strips which line up with passages 129E, 129F, 129G and 129H. Each strip can then be attached to the corresponding one of ramp portions 129A, 129B, 129C and 129D by soldering, brazing, welding, adhesive or the like. Ramp portions 129A, 129B, 129C and 129D may each have a helix angle equivalent to that of heat exchanger 20 at full extension. Each of these ramp portions may extend, for example through approximately ¼ circle.

In the illustrated embodiment a cylindrical plug 23 projects from head 16 into chamber 12. Plug 23 may have a length such that it projects almost to the top-dead-center position of piston 18. In an alternative embodiment, plug 23 is provided on piston 18 instead of on head 16. In a further alternative embodiment shorter plugs are provided on both of piston 18 and head 16. In a further alternative embodiment a longer plug extends from piston 18 through an aperture in head 16. Seals prevent leakage of compressed gas through the aperture around the plug. Plug 23 has a diameter almost equal to an inner diameter of the coils of heat exchanger 20 such that, when piston 18 is at top dead center the compressed heat exchanger 20 substantially fills the volume of chamber 12. Plug 23 substantially fills the volume inside the inner diameter of heat exchanger 20. This increases the compression ratio of compressor 10.

In some embodiments plug 23 includes features which guide the orderly compression and extension of heat exchanger 20. For example, plug 23 may comprise one or more longitudinal slots that receive corresponding tabs that project radially inwardly from inner edges of one or more turns of heat exchanger 20. Plug 23 may optionally support other features, for example, in some embodiments plug 23 is hollow. In some embodiments plug 23 contains one or more gas passages and/or one or more associated valve(s) for allowing gas to enter and/or exit chamber 12.

Compressor 10 has a gas inlet valve 25A and a gas outlet valve 25B. Gas to be compressed is drawn into chamber 12 from an inlet conduit 26A through inlet valve 25A. Compressed gas is expelled through valve 25B into an outlet conduit 26B. Valves 25A and 25B may be one-way valves such as reed valves, ball valves, flap valves, or the like. In the alternative, one or both of valves 25A and 25B may be controlled to open and close at appropriate times in the cycle of operation of compressor 10, for example, one or both of valves 25A and 25B may comprise a rotary valve, slide valve, poppet valve, solenoid valve, or the like.

Passages leading from valves 25A and 25B respectively open into grooves 24A and 24B that extend generally longitudinally along the portion of the wall of cylinder 14 that is between piston 18 and head 16 when piston 18 is at top-dead-center. Groove 24A facilitates flow of gas into the spaces between surfaces of heat exchanger 20 from valve 25A. Groove 24B facilitates flow of compressed gas from between the surfaces of heat exchanger 20 to outlet valve 24B during the final part of the compression cycle It can be appreciated that heat exchanger 20 may have a surface area significantly greater than a surface area of the walls of chamber 12 (e.g. greater than the areas of the face of piston 18, head 16, cylinder 14 and plug 23, if present that define chamber 12). For example, a cylinder with 1 liter free volume, bore 11 cm, stroke 10.5 cm, plug diameter 2.54 cm, plug length 10.5 cm, heat exchanger leaf thickness 0.318 cm results in 34 coils and a heat exchanger surface area of 0.6 $m^2$. Combined with the piston and cylinder wall this results in 12.4 times the surface area when the piston is at bottom dead center and 36 times the surface area when the piston is at top dead center as compared to a compressor without a heat exchanger as described. In the illustrated embodiment heat exchanger 20 comprises twelve coils and a ratio of the surface area of the heat exchanger to the maximum surface area of the walls of chamber 12 is approximately 5½ times when the piston is at bottom dead center and 16 times when the piston is at top dead center.

Figure 2A:
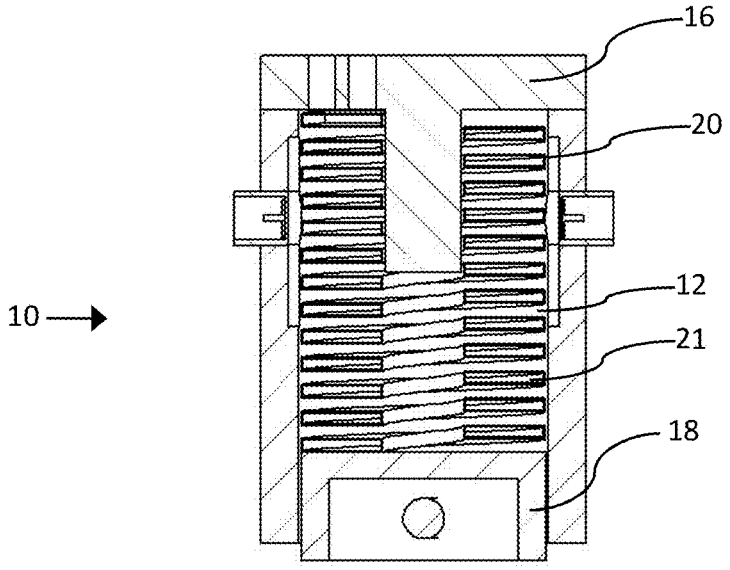
FIGS. 2A, 2B, 2C and 2D illustrate stages in a cycle of operation of the compressor of FIG. 1.

FIGS. 2A, 2B, 2C and 2D illustrate stages in a cycle of operation of compressor 10. In FIG. 2A, piston 18 is at bottom-dead-center, heat exchanger 20 is fully extended, and gas to be compressed fills chamber 12 around heat exchanger 20.

Figure 2B:
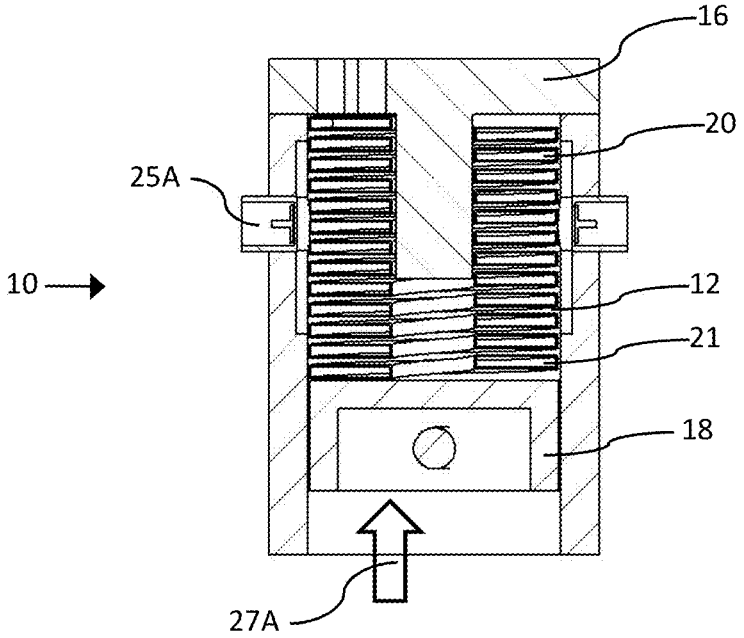

In FIG. 2B piston 18 is traveling toward head 16 as indicated by arrow 27A, valve 25A is closed and gas within cylinder 12 is being compressed. The coils of heat exchanger 20 are becoming more closely spaced and the gas being compressed is cooled by contact with heat exchanger 20. Heat extracted from the compressed gas is carried off in the heat exchange fluid flowing through the passage(s) 21 of heat exchanger 20.

Figure 2C:
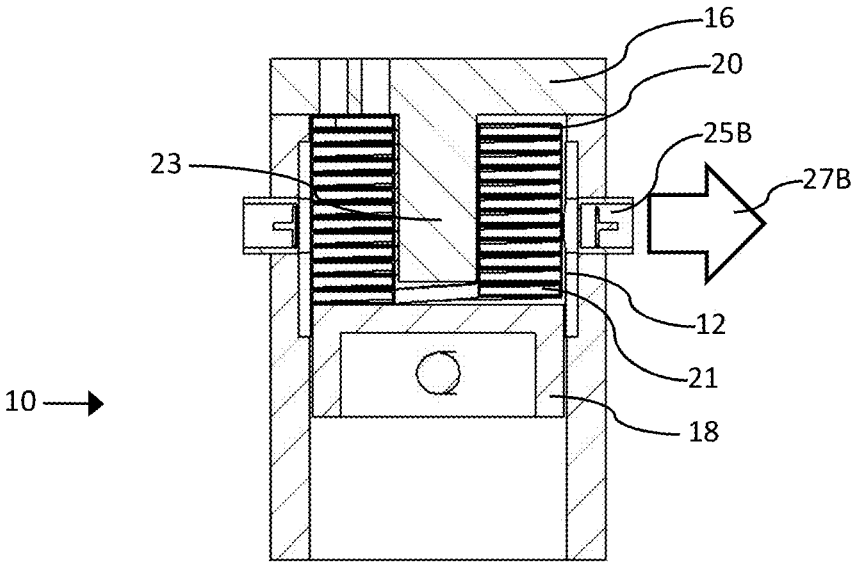

In FIG. 2C piston 18 is at top dead center almost touching plug 23 so that the chamber is reduced to a toroidal volume surrounding plug 23 that is almost entirely filled by heat exchanger 20. Heat exchanger 20 has been compressed so that its turns are touching or nearly touching. The last of the compressed gas is exiting through valve 25B as indicated by arrow 27B.

Figure 2D:
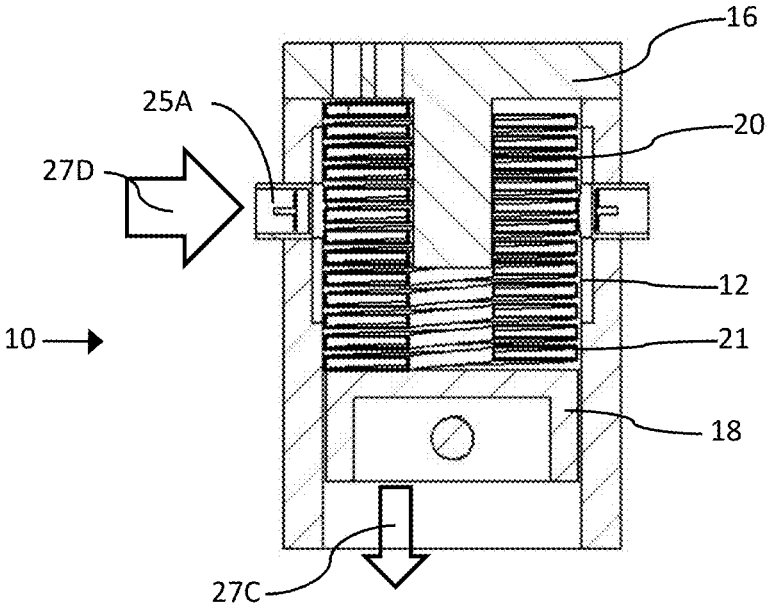

In FIG. 2D, piston 18 is moving back toward its bottom-dead-center position as indicated by arrow 27C. Valve 25A has opened and gas is entering chamber 12 through valve 25A as indicated by arrow 27D. Heat exchanger 20 is being stretched and its coils are becoming more widely separated as piston 18 moves farther from head 16.

Extraction of heat from the gas being compressed while the gas is being compressed (as opposed to after compression by an after-cooler) is advantageous because it reduces the work needed to compress the gas and also reduces loss of energy in the form of heat after the gas has been compressed (because the compressed gas may have a temperature very close to ambient temperature) Ideally the rate at which heat is extracted from the gas being compressed is equal to the rate at which energy is being put into the compressed gas in the form of heat. For example, for a 10 HP compressor, heat should be extracted at a rate of about 7½ kW.

The construction of compressor 10 may be varied in many ways. For example, passages 21 may be connected in various manners. In some alternative embodiments heat exchange fluid enters a passage 21 at one end of heat exchanger 20, passes along the passage 21 and exits at the other end of heat exchanger 20. For example, passages 21 at a first end of heat exchanger 20 are in fluid connection by way one or more fluid-tight connections with a passage in head 16 that delivers heat exchange fluid to heat exchanger 20 and the passages 21 at a second end of the heat exchanger 20 are in fluid connection by way one or more fluid-tight connections with a passage in piston 18 that carries the heat exchange fluid away from heat exchanger 20. In some embodiments the heat exchange fluid may flow though the head of piston 18 and exit into a crank case (not shown in FIG. 1) or though passages in a connecting rod or other member driving piston 18 (not shown in FIG. 1).

In some alternative embodiments passages 21 are closed at one or both ends and the heat transfer fluid in the passages 21 provides enhanced thermal conductivity of heat exchanger 20 so that heat extracted from compressed gas is carried along heat exchanger 20 to piston 18 and/or to head 16. For example a helical heat exchanger may comprise passages closed at both ends and lined with a wicking element. The passages may contain an amount of a condensable gas. This structure provides a heat pipe, which uses capillary action to return the condensed gas from a cold end to a hot end of the passages. In an alternative embodiment tubes in heat exchanger 20 are configured in a thermosiphon arrangement in which a wicking element is not necessary but the cold end is above the hot end of the passages such that liquid that condenses at the cold end can flow back along the passages to the hot end to absorb more heat.

Heat exchanger 20 is preferably a snug fit within chamber 12 so that dead volume is minimized. It is desirable to minimize or eliminate rubbing contact between heat exchanger 20 and the inner wall of cylinder 14 or plug 23. This can be addressed by using large tolerances (i.e. spacing heat exchanger 20 away from surfaces it could possibly rub against, applying wear-resistant coatings on heat exchanger 20 and/or surfaces of cylinder 14 and plug 23, selecting materials for heat exchanger 20, plug 23 and cylinder 14 that have good wear characteristics and/or providing a lubrication system to introduce a lubricant into chamber 12.

Heat exchanger 20 may be formed so it acts like a compression spring, being under compressive tension at all positions in operation. In the alternative, heat exchanger 20 may be formed to act like a expansion spring, or have no spring properties at all. In some embodiments, heat exchanger 20 has a neutral position such that the heat exchanger has a length less than the maximum length of chamber 12 and more than the minimum length of chamber 12 such that heat exchanger 20 is stretched when piston 18 is at bottom-dead-center and is compressed from its neutral position when piston 18 is at top-dead-center.

Different types of material and hardening may be used to control the spring constant. k of the heat exchanger. Different parts of the heat exchanger may have different values of k.

Figure 3A:
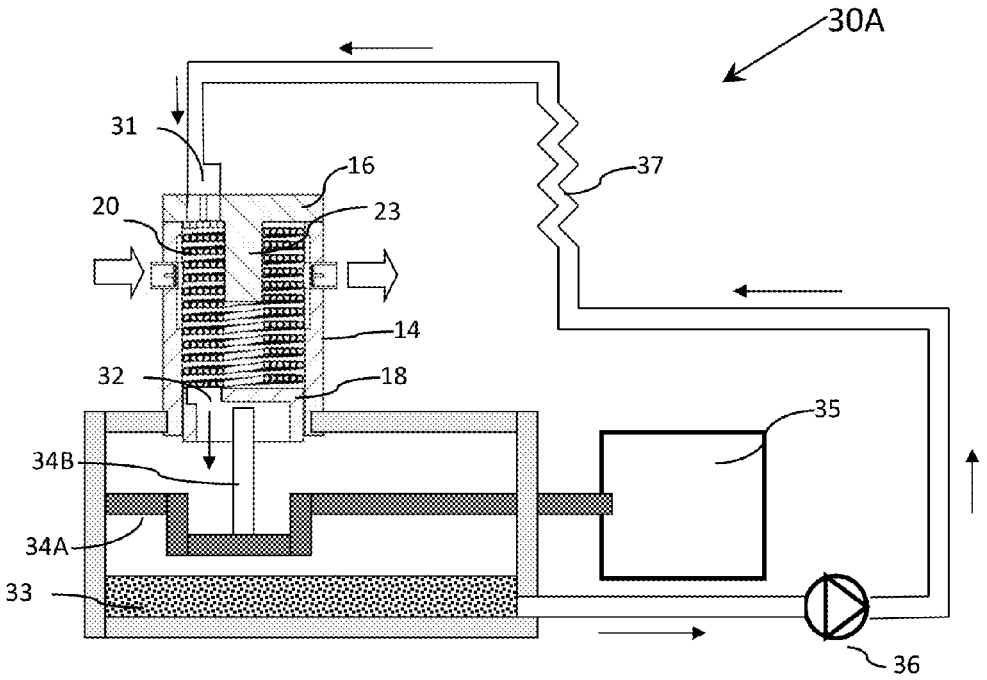
FIGS. 3A, 3B and 3C show schematically compressor systems according to example embodiments.
Figure 3B:
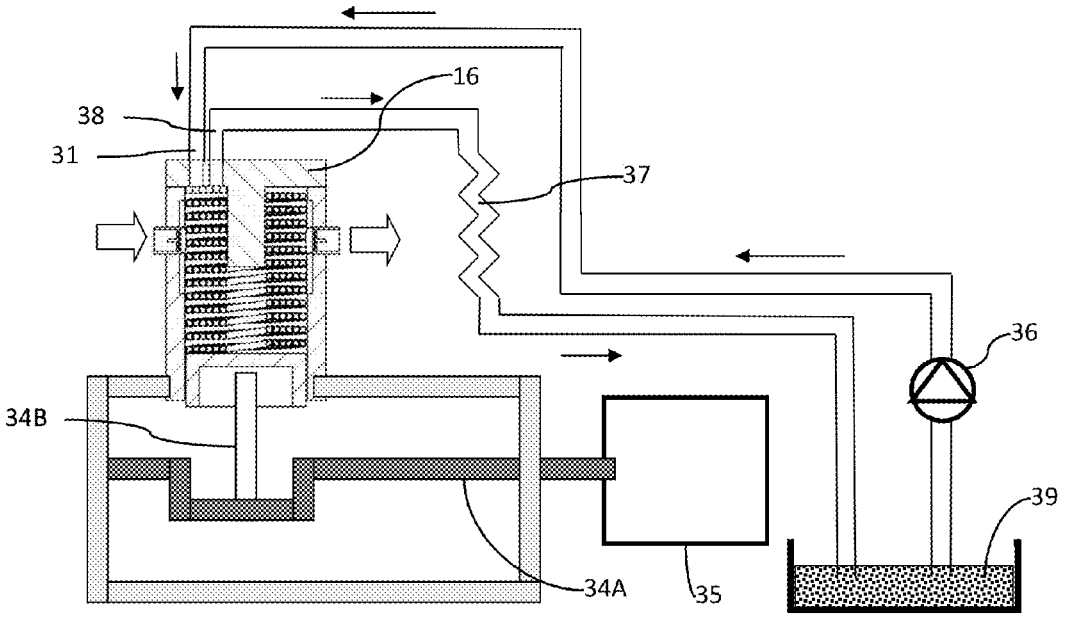
Figure 3C:
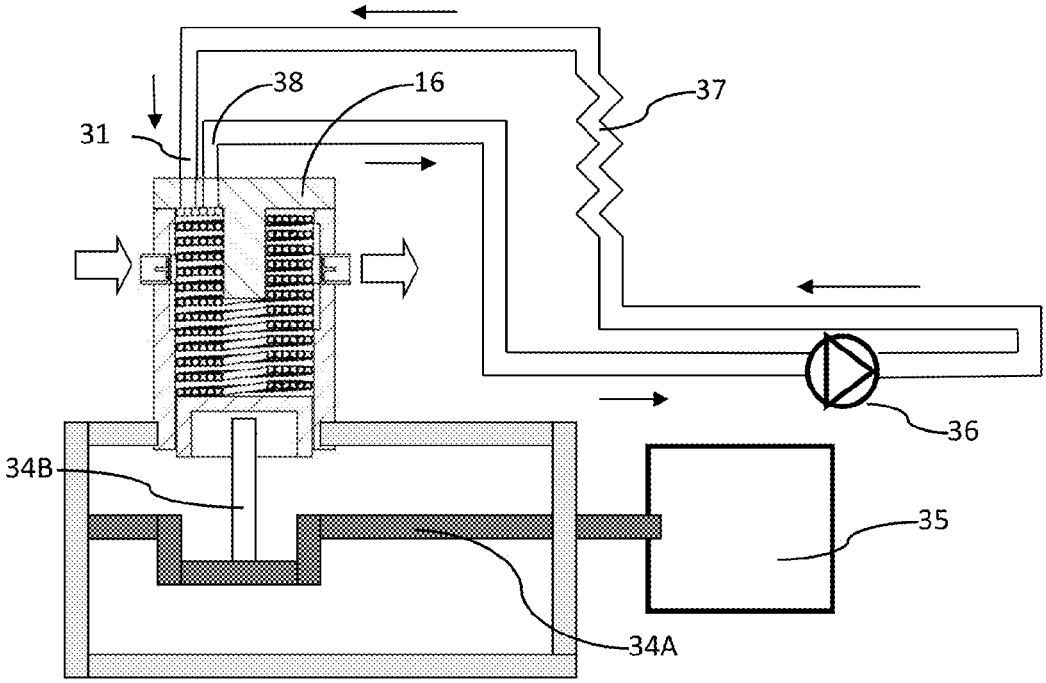

FIGS. 3A and 3B show schematically compressor systems 30A and 30B according to example embodiments. In system 30A heat exchange fluid is supplied to heat exchanger 20 by way of a passage 31 in head 16. The heat exchange fluid flows through heat exchanger 20 and exits heat exchanger 20 though a passage 32 in piston 18. The heat exchange fluid falls into a crankcase 33 containing a crankshaft 34A and connecting rod 34B. A motor 35 drives crankshaft 34A to rotate to cause reciprocation of piston 18. A pump 36 recovers the heat exchange fluid and passes the heat exchange fluid through a heat exchanger 37. Cooled heat exchange fluid exits heat exchanger 37 and is carried back to passage 31. Heat exchanger 37 may transfer the heat to another medium and/or dissipate the heat into the air or a liquid or the like. For example, heat exchanger 37 may comprise a liquid/air or liquid/liquid heat exchanger.

Compressor system 30B is similar to compressor system 30A and like-numbered elements are the same as or similar to those of compressor system 30A. Compressor system 30B differs from compressor system 30A in that heat exchange fluid exits from heat exchanger 20 through a second passage 38 in head 16 and is delivered to a reservoir 39 by way of a heat exchanger 37. The heat exchange fluid is pumped back into heat exchanger 20 by way of passage 31.

Compressor system 30C is similar to compressor system 30B and like-numbered elements are the same as or similar to those of compressor system 30B. Compressor system 30C differs from compressor system 30B in that there is no fluid reservoir and the heat exchange fluid flows in a closed loop. Heat exchange fluid exits from heat exchanger 20 through a second passage 38 in head 16 and is delivered to pump 36. The heat exchange fluid is pumped back into heat exchanger 20 by way of heat exchanger 37 and passage 31.

Various alternatives are possible within the scope of the invention. For example, in some embodiments two or more extendible heat exchangers are intertwined within a compressor chamber. A heat exchanger may have any practical form that can expand and contract such that it fills a compression chamber essentially evenly, can be compressed to leave very little gaps, and has a path inside for the fluid to circulate could be used. It is not necessary for the chamber to be cylindrical. A piston 18 and cylinder 14 could be oval or some other non-round shape. Heat exchanger 20 could be shaped to match the chamber. Additional passages for circulating heat exchange fluid could optionally also be provided in the walls of chamber 12 including, for example, inside plug 23, inside a piston 18, inside a cylinder head or the like. A heat exchanger as described herein could be provided between two pistons that reciprocate toward and away from one another in a single cylinder. A surface of a heat exchanger 20 could be textured or have small projections or indentations to assist with heat transfer. In some embodiments the surfaces of heat exchanger 20 are penetrated by apertures and/or are porous and/or are textured to provide additional surface area for rapid heat transfer between the gas in chamber 12 and the heat exchange fluid in heat exchanger 20.

It is not mandatory that chamber 12 be defined in a cylinder between a movable piston and a stationary head. A chamber 12 may be defined, for example, in a cylinder between two reciprocating pistons that each move to cause the volume of the chamber to vary. In other embodiments an extensible heat exchanger as described generally herein is provided in a bellows-type variable-volume chamber.

While it is desirable (although not mandatory) to have gas inlets and outlets that are configured to introduce into or remove gas from cylinder 14 along the entire longitudinal distance from the head of piston 18 at top-dead-center to head 16 the positions of the inlets and outlets may be varied. For example one or more gas inlets, gas outlets, or both gas inlets and gas outlets may be provided in plug 23.

A heat exchanger as described herein may be made in a wide range of ways. One non-limiting example way to fabricate a heat exchanger 20 of the general type described above is to form a flat coil from a plurality of thin (e.g. ⅛ inch) hollow square or rectangular tubes each shaped into a helical form such that the inside diameter of the helix formed by one of the tubes is substantially equal to the outside diameter of the helix formed by an adjacent one of the tubes. The individual coiled tubes may be nested together to form a flat helix. The nested tubes may optionally be affixed together by way of solder, brazing, welding, a suitable adhesive, or the like. An advantage of a heat exchanger formed so that major surfaces of adjacent coils are flat is that, when fully compressed, there is very little gap between the adjacent coils of the heat exchanger.

Optionally the tubes and/or other elements from which the heat exchanger is made comprise one or more alignment features on their exterior surfaces that can be engaged with corresponding features on adjacent tubes and/or other elements to facilitate alignment of the tubes and/or other elements.

One way to form tubes for such a heat exchanger is to bend metal tubes around cylindrical forms of suitable diameter so that the tubes spring back to the desired finished diameters. The finished diameters are selected to that each tube fits inside the next-bigger tube (e.g the helix outer diameter of one tube matches the helix internal diameter of the next tube).

A heat exchanger as described herein may, in the alternative, be fabricated using 3D fabrication processes such as 3D laser sintering or the like. 3-D fabrication may be applied to provide internal channels with internal interconnections and/or structures on internal surfaces to facilitate improved heat transfer. Structuring of external surfaces could also be provided.

In a less-preferred embodiment the individual tubes are round. Such embodiments have the disadvantage that more gaps will be present between adjacent coils of the heat exchanger when the heat exchanger is fully compressed. this reduces the achievable compression ratio of the compressor. Where round tubing is used, grooves between adjacent tubes may optionally be filled with a solid filler such as a solder.

A wide range of alternative constructions are possible for heat exchanger 20, for example:

While it is preferred the surfaces of adjacent coils of heat exchanger 20 be flat, other geometric shapes are possible if when the leafs are fully compressed they fit together without excessive air gaps.

The bores of the tubes which provide passages 21 may have different cross-sectional shapes than the outsides of the tubes. For example a tube may be used that is square or rectangular on the outside but has a circular bore.

Not all tubes in the helix need to be identical to each other. In one variation, the inner most and outer most are not tubes at all, but solid square or rectangular rods having the same thickness as the tubes. This facilitates machining outside and inside surfaces of the heat exchanger for a high precision fit in the cylinder.

Heat exchanger 20 may be fabricated from tubes such that one or more pairs of adjacent tubes are spaced apart from one another by helixes of a solid material or by other tubes that are not connected to carry a flow of heat exchange fluid.

In some embodiments, the thickness of the tubing used to make heat exchanger 20 is made to vary from end to end or side to side of heat exchanger 20 to provide desired mechanical characteristics.

Apparatus like compressor 10 may also be applied with minor modifications as an isothermal or nearly-isothermal expander. An expander may operate in a manner similar to a compressor except that high pressure gas is introduced into chamber 12 when piston 18 is at or near top-dead-center (e.g. valve 26B may be opened when piston 18 is at or near top-dead-center and held open to admit high-pressure gas into cylinder 12 for a fixed or variable delay after top-dead-center). After valve 26B (now configured as an intake for high pressure gas) closes the gas in chamber 12 expands and starts to drop in temperature. Heat exchanger 20 transfers heat into the gas in chamber 12 to reduce or eliminate the drop in temperature of the expanding gas. When piston 18 is at bottom-dead-center and the gas is fully expanded, valve 26A (now configured as a low-pressure gas outlet) opens to allow the gas to be expelled from chamber 12 as piston 18 moves back up toward top-dead center. This exit of gas continues until piston 18 reaches top-dead-center at which point the expansion cycle repeats. The flow of heat exchange fluid may be the same as described above except that the heat exchange fluid is heated before being introduced into heat exchanger 20.

Figure 4:
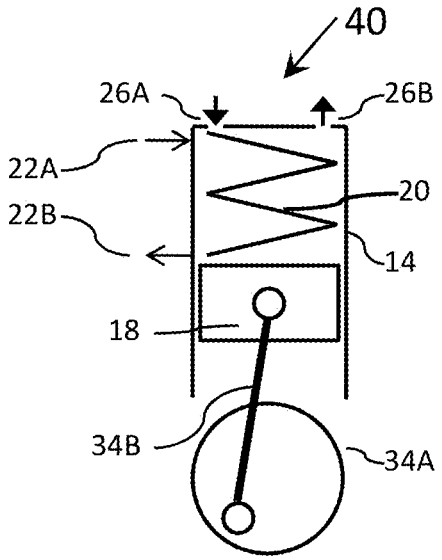
FIG. 4 shows schematically an example single stage isothermal machine which may be configured as a compressor or as an expander.

Compressors and/or expanders as described herein may be applied in a wide range of systems of which the following are some non-limiting examples. FIG. 4 shows schematically a single stage isothermal machine 40 which may be configured as a compressor or as an expander by appropriately setting the timing of valves arranged to open chamber 12 to low-pressure gas and to high-pressure gas.

Figure 5:
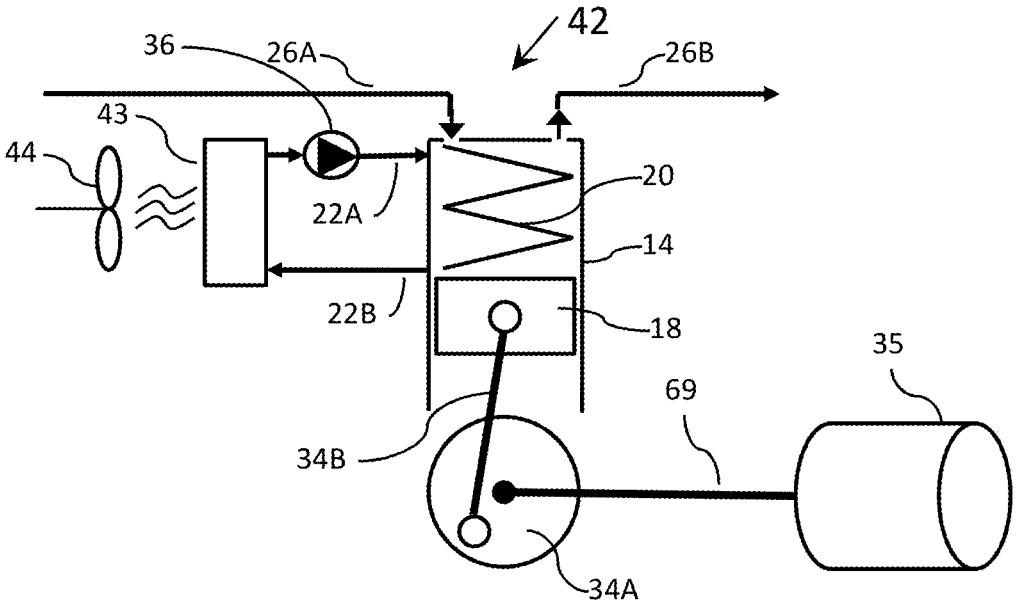
FIG. 5 shows schematically an example single-acting isothermal gas compressor system.

FIG. 5 shows schematically a single-acting isothermal gas compressor system 42. In system 42 heat exchange fluid is circulated through a radiator 43. A fan 44 moves air past radiator 43 to dissipate heat from the heat exchange fluid. Alternative devices for removing heat from the heat exchange fluid may be provided in place of radiator 43. Some examples are a heat exchanger, external water cooler, evaporative cooler and the like. FIG. 5 also shows a drive motor 35.

Figure 6:
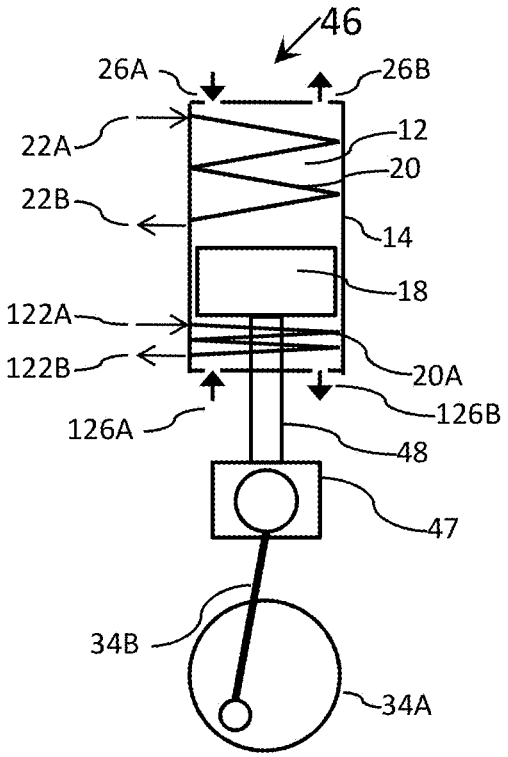
FIG. 6 shows schematically an example double-acting single-cylinder isothermal machine.

FIG. 6 shows schematically a double-acting single-cylinder isothermal machine 46. In machine 46 a second chamber 12A is defined on a second side of piston 18. Piston 18 is driven by a rod 48 coupled to a cross-head 47. Cross-head 47 causes rod 48 to reciprocate linearly. Second chamber 12A contains a second heat exchanger 20A which is connected to receive heat exchange fluid at inlet 122A and to discharge heat exchange fluid that has passed through heat exchanger 20A at outlet 122B. Second heat exchanger 20A may be a helical heat exchanger, as described above, that coils around piston rod 48. Piston rod 48 may have a diameter nearly equal to an inner diameter of the helix of second heat exchanger 20A. A seal around piston rod 48 prevents gas from leaking out of chamber 12A around rod 48.

A gas inlet 126A is valved to allow gas to enter chamber 12A and a gas outlet 126B is valved to allow gas to exit from chamber 12A. Machine 46 may be configured as a compressor, as an expander, or one chamber 12 or 12A may be configured as a compressor while the other chamber 12A or 12 is configured as an expander. In some embodiments, both chambers 12 and 12A are configured as compressors and the output of one of chambers 12 and 12A is coupled to the inlet of the other one of chambers 12A and 12 to provide a two-stage compressor. In another embodiments, outputs from chambers 12 and 12A are combined to yield a larger volume of compressed gas.

A machine having a configuration like that of machine 46 is particularly useful in cases where both chambers 12 and 12A are run at the same temperature.

Figure 7:
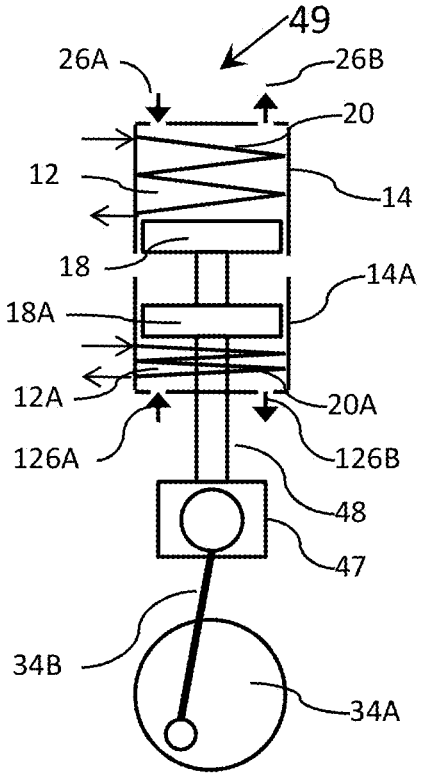
FIG. 7 shows schematically an example double-acting isothermal machine according to an alternative construction.

FIG. 7 shows schematically a double-acting isothermal machine 49 according to an alternative construction in which second chamber 12A is provided in a separate cylinder 14A containing a separate piston 18A. Pistons 18 and 18A are driven together by a common piston rod 48A. Cylinders 14 and 14A are optionally thermally insulated from one another by an air gap and/or by a spacer made of a thermally-insulating material. The construction illustrated in FIG. 7 is particularly useful in cases where it is desired to operate chambers 12 and 12A at different temperatures (for example in a Stirling configuration with a hot side and a cold side) with minimal heat transfer between the two chambers.

Figure 8:
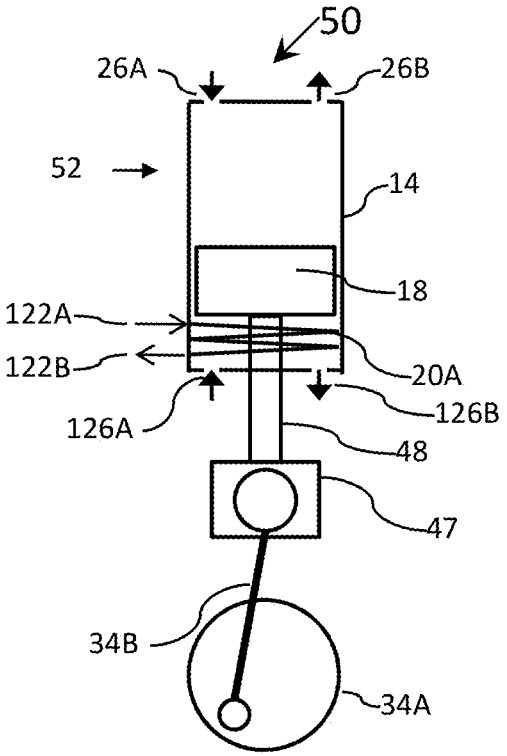
FIG. 8 shows schematically an example machine which provides a combined isothermal compressor and adiabatic expander.
Figure 9:
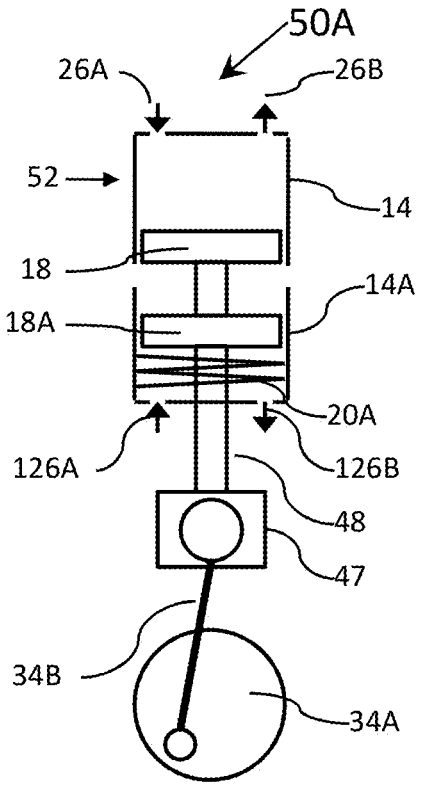
FIG. 9 shows an example machine according to another construction which provides a combined isothermal compressor and adiabatic expander in which the adiabatic expander and isothermal compressor comprise individual pistons that are commonly driven.

FIG. 8 shows schematically a machine 50 which provides a combined isothermal compressor and adiabatic expander with shared piston and cylinder. FIG. 9 shows a machine 50A which also provides a combined isothermal compressor and adiabatic expander but differs from machine 50 in that the adiabatic expander and isothermal compressor comprise individual pistons 18 and 18A that are commonly driven by a common piston rod 48A. In each case the adiabatic expander 52 comprises a chamber defined in a cylinder between a head 16 and a reciprocating piston 18.

Figure 10:
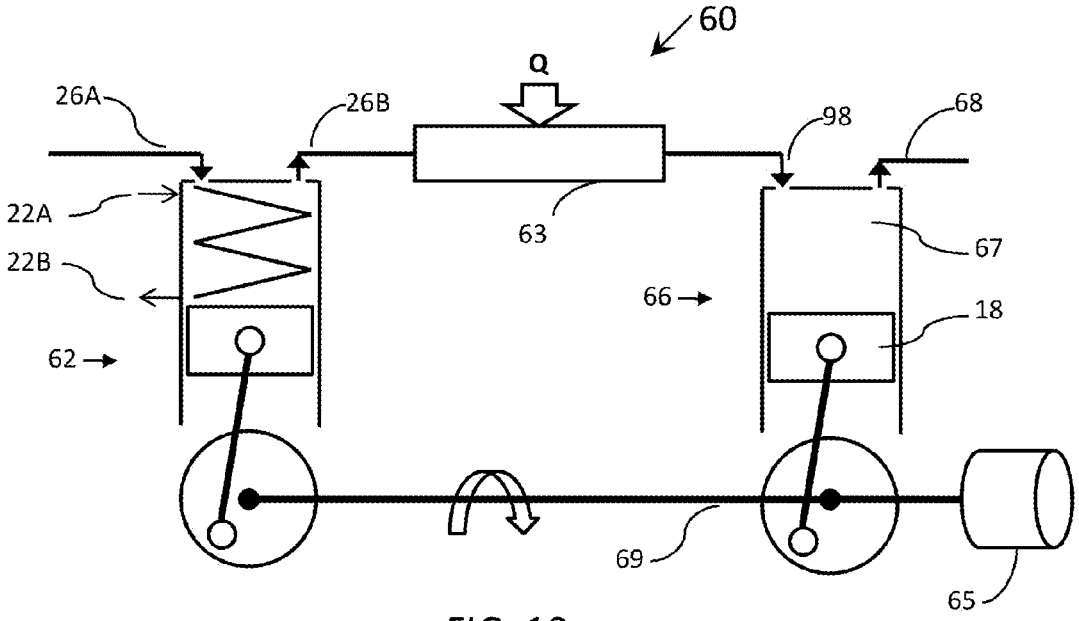
FIG. 10 shows schematically an example system comprising an isothermal compressor that may be applied to drive a load such as a generator using energy from heat.

FIG. 10 shows schematically a system 60 comprising an isothermal compressor 62 connected to take in and compress air from an intake 61. Compressed air output by compressor 62 passes through a heat exchanger 63 where it is heated by heat Q. Heat Q may come from any suitable source, for example hot exhaust gases from an internal combustion process, direct or indirect heat from an external combustion process, solar heating, complete or partial oxidation of coal, biomass, or the like, geothermal energy, waste heat from a process, waste heat from the exhaust of an internal combustion engine, waste heat from the exhaust of an incinerator, furnace, or the like, and so on. Heat Q is not necessarily from a source external to heat exchanger 63. In some embodiments, heat exchanger 63 comprises its own heat source such as a burner that generates heat by combustion of a suitable fuel such as kerosene, natural gas, oil, or the like.

Heated compressed air is supplied to adiabatic expander 66 comprising a variable-volume chamber 67. Reduced-pressure air exits at 68. Adiabatic expander 66 drives isothermal compressor 62 and a load 65 such as a generator, pump, fan, compressor, transmission or the like, by way of drive shaft 69.

Although isothermal compressor 62 and adiabatic expander 66 are shown as having separate pistons 18 and cylinders 14, isothermal compressor 62 and adiabatic expander 66 could also share a common piston or piston rod as illustrated, for example, in FIG. 8 or 9.

In an example application, ambient air at a pressure of 1 bar and temperature of approximately 298 K (25 C) is drawn into compressor 62. The air is compressed and cooled simultaneously in compressor 62. During compression, heat is withdrawn by heat exchanger 20 which carries heat exchanger fluid circulated through ports 22A and 22B. Once compressed, for example to 10 bar, the cool compressed air flows out outlet 26B to heat exchanger 63. Heat can be provided to the heat exchanger from a wide variety of sources, including waste heat from exhaust or cooling of an internal combustion engine, external combustion such as biomass or coal, as well as non-combustion sources such as solar or geothermal heat. For example the compressed air could be heated to 573 K (300° C.) through heat exchanger 63. This hot, compressed air enters adiabatic expander 66, where it expands and cools, transferring work energy to the piston 18 of adiabatic expander 66. When the air has been expanded, it is exhausted out of outlet 68 to the atmosphere. Work derived from the expansion drives load 65 and compressor 62. Expander 66 is not necessarily a piston-type expander but could be any adiabatic expansion device such as a turbine or a vane motor, for example.

Figure 10A:
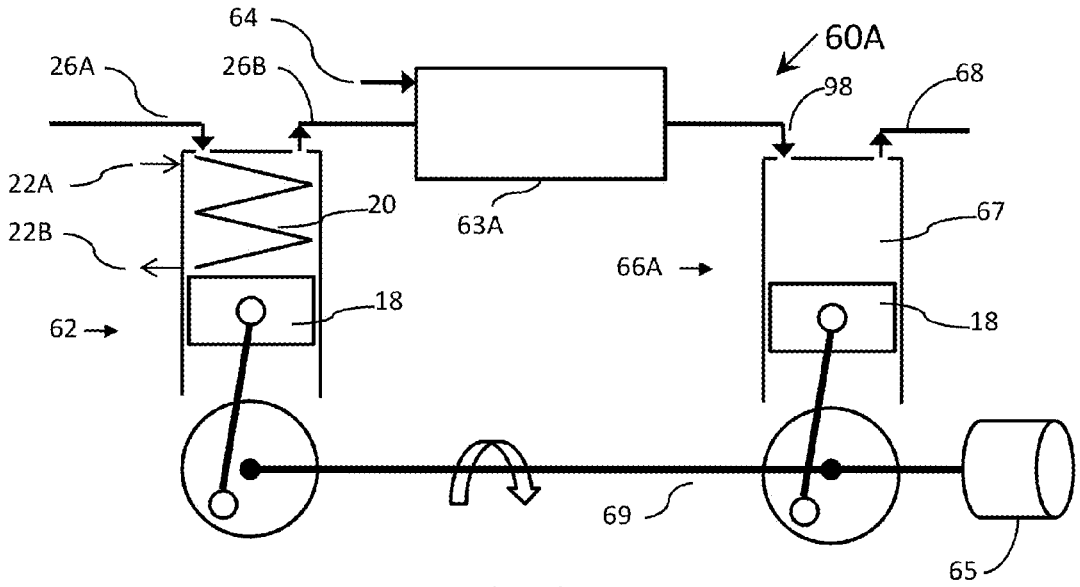
FIG. 10A shows an example system comprising an isothermal compressor an internal combustion chamber and an adiabatic expander configured as an internal combustion engine.

FIG. 10A shows a heat engine 60A. Engine 60A has a principle of operation similar to that of a Brayton Cycle (gas turbine) engine, except that the compressor is isothermal rather than adiabatic.

Heat engine 60A uses ambient air as the working fluid. Ambient air is drawn into isothermal compressor 62 through intake 26A. Typically this air is at a pressure of 1 bar and temperature of approximately 298 K (25° C.). The air is compressed and cooled simultaneously in compressor 62. Once compressed, for example to 10 bar, the cool compressed air flows to combustor 63A, where fuel is added from a fuel source 64. The fuel combusts in combustor 63A using the oxygen in the compressed air. The fuel may comprise, for example, natural gas, kerosene, fuel oil, gasoline, hydrogen, etc. The compressed air is heated to an elevated temperature, for example 1173 K (900° C.) downstream from combustor 63A. This hot, compressed air enters adiabatic expander 66A, where it expands and cools, transferring energy to a mechanical output of adiabatic expander 66A as it does. When the air has been expanded and is at a lower pressure the air is exhausted out of exhaust outlet 68 to the atmosphere. Energy derived from the expansion is transferred to drive shaft 69, which drives compressor 62 and load 65. Expander 66 does not have to be a piston-type expander but could be another suitable expander such as a turbine or a vane motor.

Figure 10B:
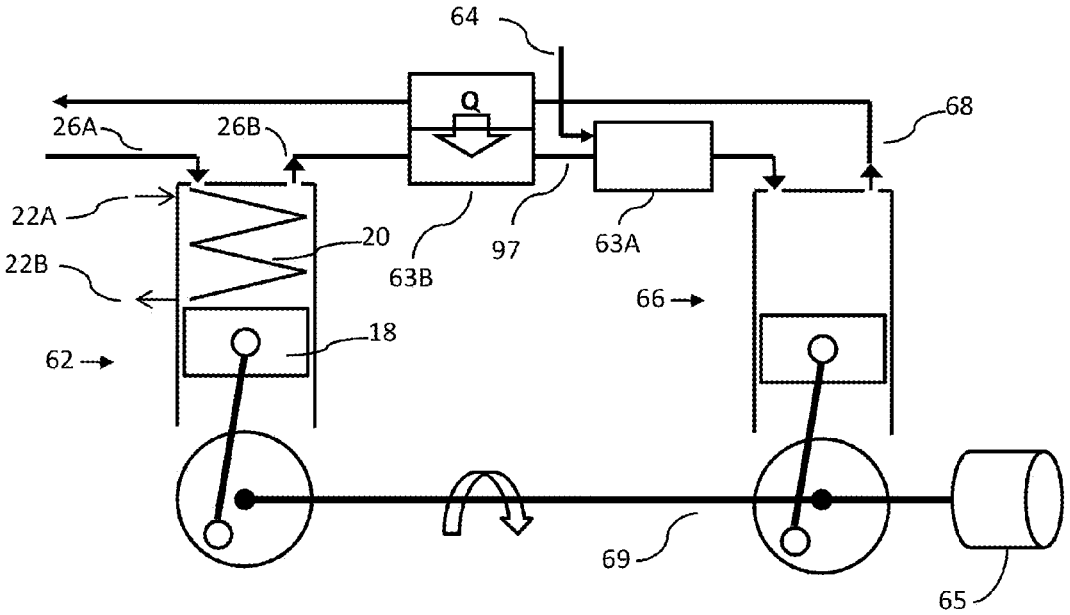
FIG. 10B shows an example system comprising an isothermal compressor an internal combustion engine and a heat exchanger configured to recover heat from exhaust of the internal combustion engine.

FIG. 10B shows a heat engine similar to that of FIG. 10A with the addition of an exhaust gas economizer 63B. Economizer 63B comprises a gas-to-gas heat exchanger. Using an isothermal compressor 62 provides an increased temperature differential between compressed gas on the cool side of economizer 63B and exhaust gases on the hot side of economizer 63B. This, in turn, allows economiser 63B to recover more energy from the hot exhaust gas than would be possible if the gas compressed by compressor 62 was hotter.

Figure 10C:
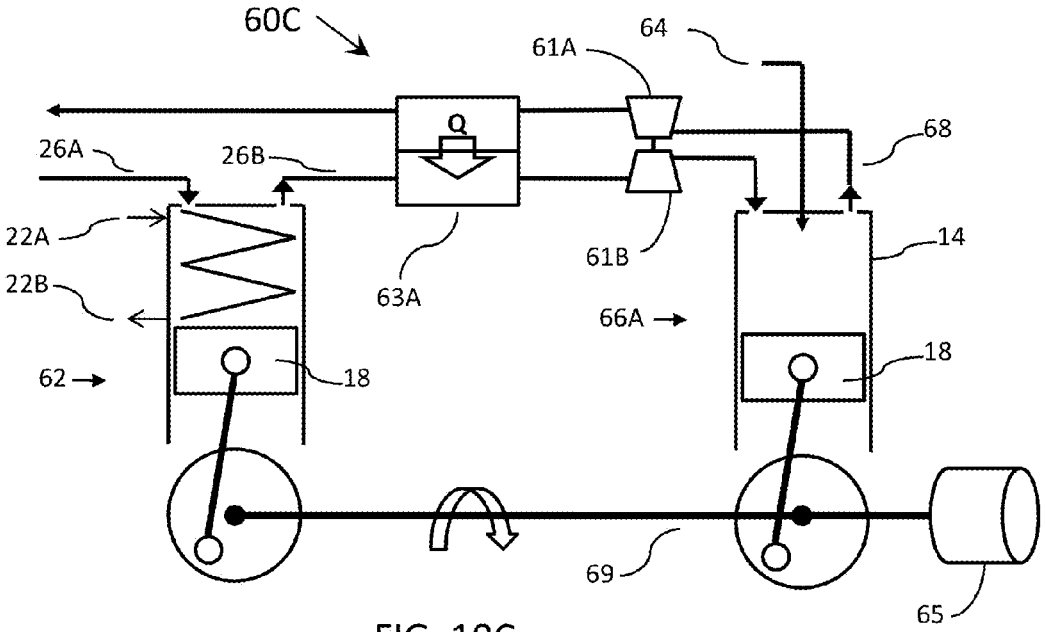
FIG. 10C shows an example system comprising an isothermal compressor an internal combustion engine and a heat exchanger configured to operate in a modified auto/diesel cycle and to recover heat from exhaust of the internal combustion engine.

FIG. 10C shows an example system 60C comprising an isothermal compressor 62, an internal combustion engine 66A and a heat exchanger 63A configured to recover heat from exhaust 68. Also shown in FIG. 10C is an optional turbocharger comprising a turbine 61A driven by the flow of gas at exhaust 68 and a compressor 61B connected to further compress air being delivered to engine 66A. Engine 66A may operate on a two-stroke power cycle such that fuel is ignited in each cycle of the piston or on a four-stroke cycle.

In an alternative embodiment, internal combustion engine 66A comprises a turbine.

Figure 10D:
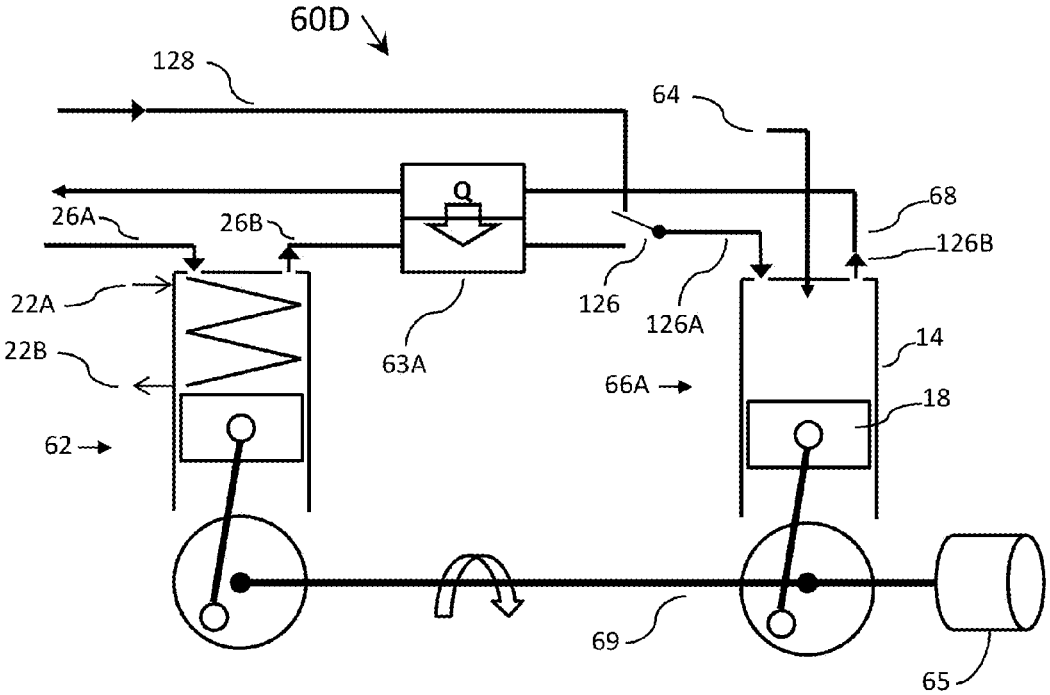
FIG. 10D shows an example system comprising an isothermal compressor an internal combustion engine and a heat exchanger configured to operate in a modified auto/diesel cycle and to recover heat from exhaust of the internal combustion engine wherein the engine is switchable between a conventional mode without isothermal compression and an economy mode with isothermal compression.

FIG. 10D shows an internal combustion engine system 60D with exhaust gas heat recovery. System 60D is similar to system 60C except that it can run in "conventional" mode with isothermal compressor 62 and counter flow heat exchanger 63A bypassed for starting and when maximum power is required. When high economy is desired air can be drawn by way of isothermal compressor 62 and heat exchanger 63. Bypass valve 126 controls the air flow into the combustion cylinder 66A and thus the mode the engine is operating in. In the illustrated embodiment, bypass valve 126 can be set to supply air to intake 126A of combustion cylinder 66A from an intake 128 (in conventional mode) or from the output of isothermal compressor 62 (in a high efficiency mode). Optionally a clutch or other mechanism is provided to disengage isothermal compressor 62 when the system is in the conventional mode to save more energy.

Figure 11:
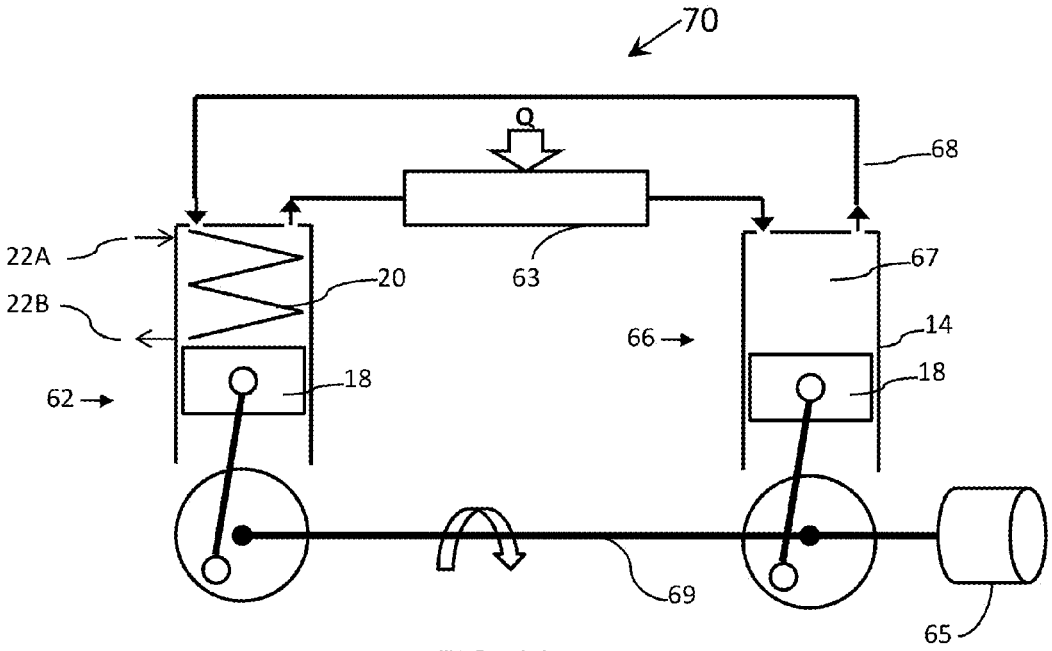
FIG. 11 is a schematic diagram illustrating an example system for driving a load using energy from heat that operates on a closed cycle.

FIG. 11 is a schematic diagram illustrating a system 70 that is similar to system 60 but set up to operate on a closed cycle in which air or another gas output from adiabatic expander 66 is recycled to the input of isothermal compressor 62. The working gas circulating in system 70 may comprise any suitable gas, for example, air, nitrogen, argon, helium, hydrogen or the like. Helium and hydrogen are especially suitable given their higher heat conductivity. A radiator may optionally be provided in return line 68 that recycles gas from the output of adiabatic expander 66 back to the input of isothermal compressor 62. A system like system 70 may be applied to generate electrical power from any suitable source of heat. For example, heat exchanger may comprise a gas-to-gas heat exchanger, such as a counterflow heat exchanger carrying hot exhaust gas from a furnace, engine, or the like on a primary side and carrying the gas circulating in system 70 on the secondary side. Heat energy extracted from the hot gas may drive a load 65 such as a generator. In some embodiments the pressure of the circulating gas is increased. This facilitates increasing the power per stroke. In some embodiments the pressure is variable to provide control over the power per stroke.

Figure 12:
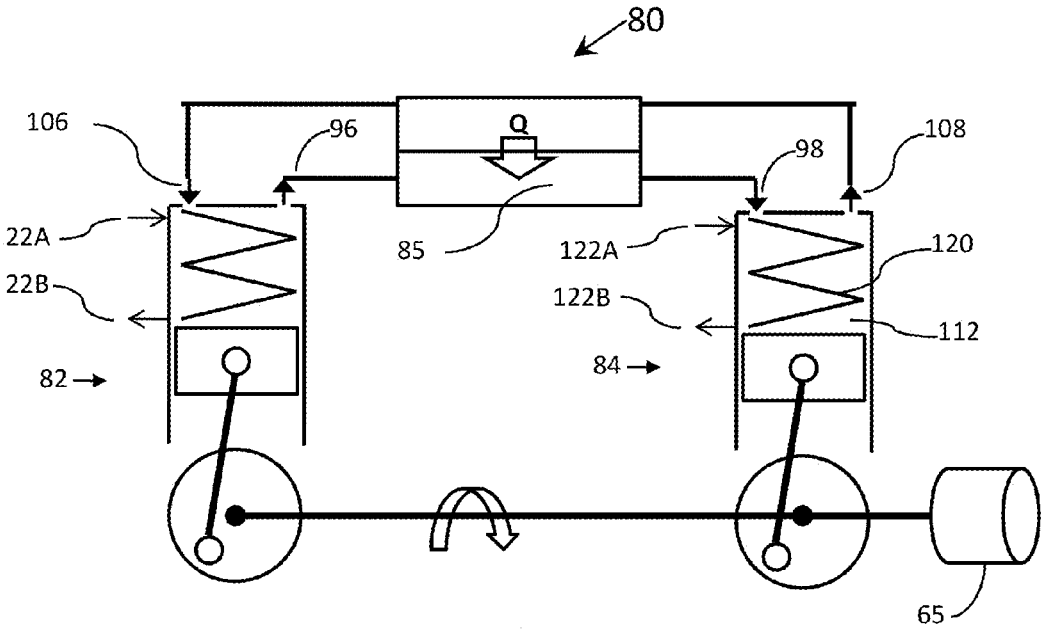
FIG. 12 is a schematic diagram illustrating an example system that is set up to operate on an Ericsson cycle.

FIG. 12 is a schematic diagram illustrating a system 80 that is set up to operate on an Ericsson cycle. System 80 comprises an isothermal compressor 82 and an isothermal expander 84. A circulating gas is compressed in isothermal compressor 82, valve 96 opens and the compressed gas passes to isothermal expander 84 by way of a gas-to gas heat exchanger, 85 which may comprise a counterflow heat exchanger. Valve 98 opens allowing hot compressed gas into expander 84, then valve 98 closes and the gas is allowed to expand to do work. In the illustrated embodiment, reciprocation of piston 18 in expander 84 drives compressor 82 and a load 65. Heat from an external source is introduced to the expanding gas in expander 84 by way of the heat exchange fluid circulated through heat exchanger 120 by way of ports 122A and 122B. Valve 108 opens and the gas exits expander 84 and returns to compressor 82 by way of heat exchanger 85. Heat is removed from compressor 82 by the heat exchange fluid circulated through heat exchanger 20 by way of ports 22A and 22B. Heat exchanger 85 transfers heat from the gas returning to compressor 82 to the compressed gas that has left compressor 82 and is being carried to expander 84 through valve 96. An Ericson cycle is able to approach the Carnot efficiency by isothermal heat injection and isothermal heat extraction.

Although isothermal compressor 82 and isothermal expander 84 are shown as having separate pistons 18 and cylinders 14, isothermal compressor 82 and isothermal expander 84 could also share a common piston or piston rod as illustrated, for example, in FIG. 6 or 7.

Figure 12A:
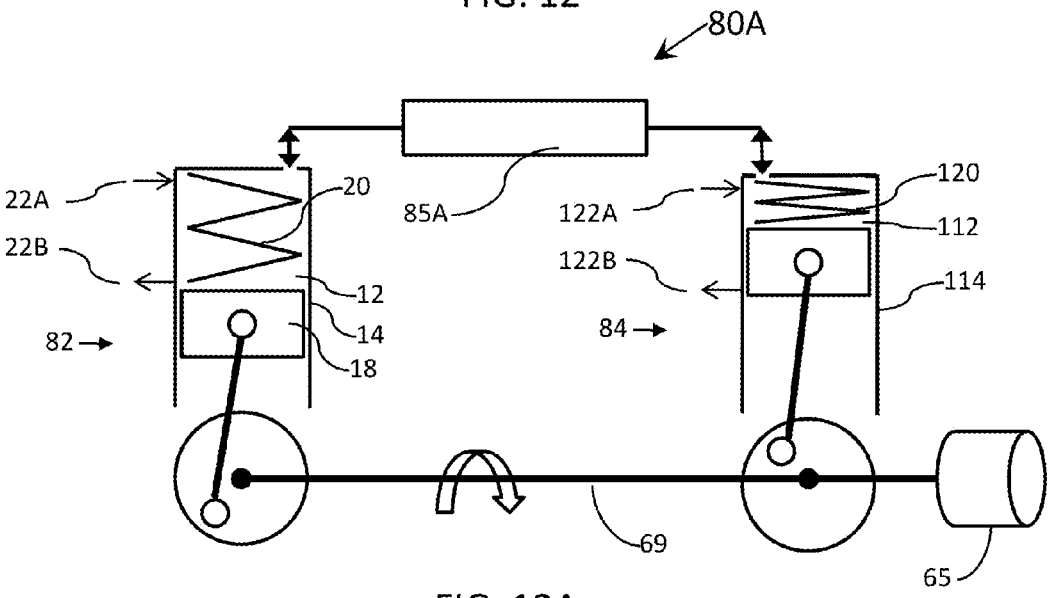
FIG. 12A is a schematic diagram illustrating a system that is set up to operate on a Stirling cycle.

FIG. 12A shows a system 80A that is similar to system 80 but set up to operate according to a Stirling cycle. In system 80A counter flow heat exchanger 85 has been replaced with a regenerator 85A, valves are removed or held open and only one flow path is provided between cylinders 14 and 114 that each serve as a compressor and expander in alternation. Pistons 18 and 118 are offset in phase so that a working fluid is pumped back and forth between the cylinders by way of regenerator 85A.

Although single-cylinder compressors and single-cylinder expanders are depicted for illustrative purposes in FIGS. 10 to 12, the compressors and/or expanders in any of these embodiments may comprise multiple cylinders.

Figure 13:
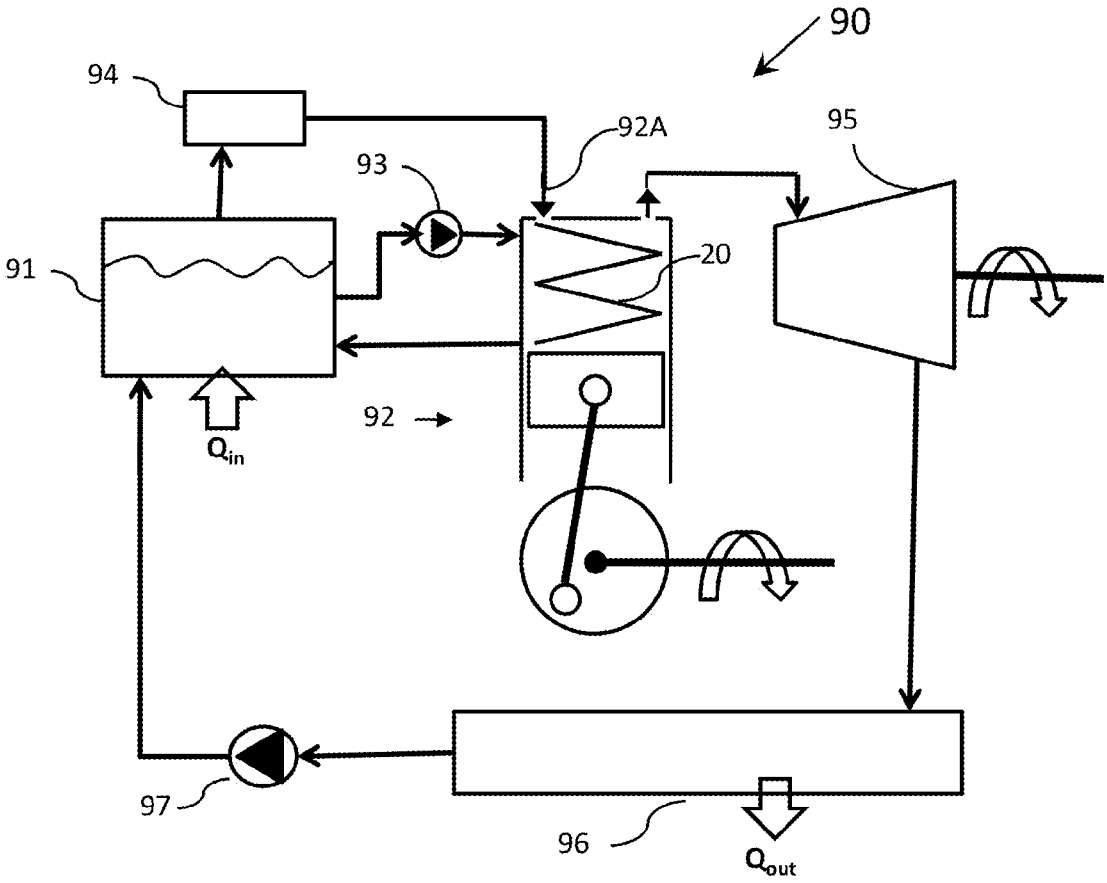
FIG. 13 is a schematic diagram illustrating a system that uses an isothermal expander in a steam application.

FIG. 13 shows an application of an isothermal expander as described herein in a Rankine (steam) engine. FIG. 13 depicts a system 90 comprising an isothermal expander 92 in place of a high pressure turbine. Isothermal expansion has the characteristic of increasing steam quality as the steam is expanded (as opposed to a adiabatic expander where the quality decreases with expansion). The isothermal expander 92 acts as a continuous reheater, unlike a conventional turbine where the steam is partially expanded and then redirected back to a boiler for reheating. Continuous reheating is results in higher efficiency due to the higher average temperature of steam. This effect is also very useful in situations where no, or limited superheating is possible, such as in solar, geothermal and nuclear applications. Having the first stage of steam expansion happen isothermally allows saturated steam coming off the boiler to become unsaturated, albeit at a lower pressure. This allows greater expansion in the low pressure turbine because the temperature of the exit steam can be lower while maintaining quality. The overall effect is again to raise efficiency.

In system 90 a boiler 91 generates hot water that is circulated through heat exchanger 20 of isothermal expander 92 by a circulation pump 93 and high pressure saturated steam that is provided to inlet 92A of isothermal expander 92 by way of steam separator 94. Steam at the inlet of isothermal expander 92 may, for example have a temperature of 200° C. and a pressure of 15 bar. Steam leaves isothermal expander 92 at a reduced pressure but the temperature of the steam is held approximately constant by heat exchanger 20. The boiler water circulating in heat exchanger 20 provides the heat required to keep the steam temperature constant as the steam expands. After expansion the steam is supplied as unsaturated vapour to low-pressure turbine 95. Steam exhausted from low-pressure turbine 95 is provided to a condenser 96 where it condenses to water which is returned to boiler 91 at high pressure by a feed water pump 97. Mechanical power is generated by both isothermal expander 92 and low-pressure turbine 95.

Figure 14:
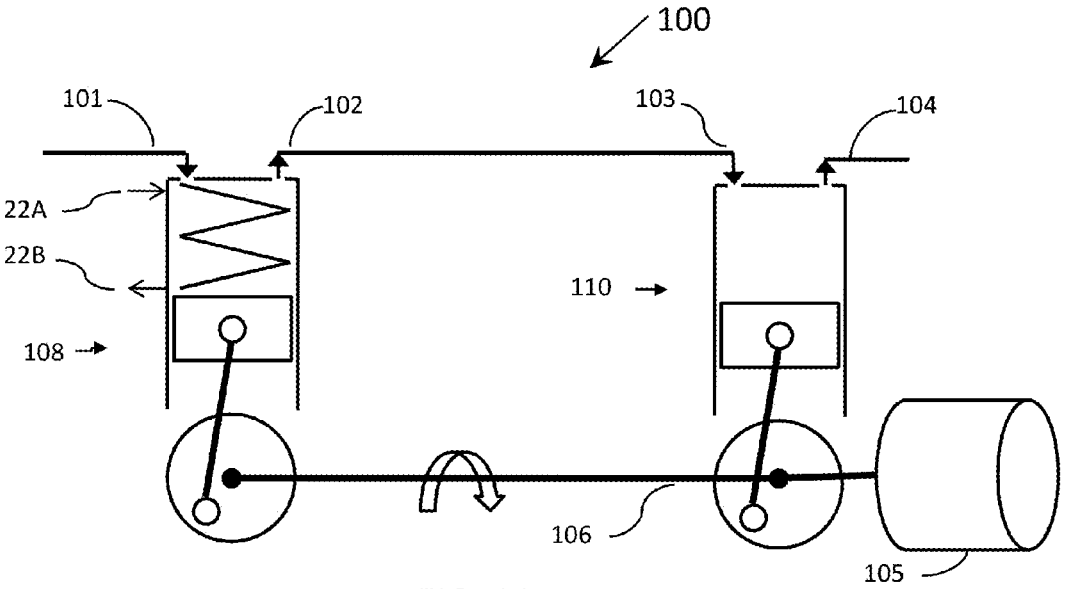
FIG. 14 is a schematic diagram illustrating a system that uses an isothermal compressor in an air cooler application.

FIG. 14 illustrates an air cooler 100. Gas to be cooled enters through valve 101 to isothermal compressor 108 where it is isothermally compressed. Heat generated during compression is removed via cooling ports 22A and 22B. The resulting compressed gas is expanded in adiabatic expander 110 providing some energy to run compressor 103 and cooling significantly. Cooled gas expelled through valve 104. Motor 105 provides the energy to run cooler 100 through crankshaft 106.

Some of the systems described herein illustrate example cases where different functions (such as compression or expansion) are provided by independent cylinders and pistons. In alternative embodiments such functions may share pistons and/or cylinders as described above.

Isothermal compressors and expanders as described herein have a wide range of applications including applications such as:

- compressing air for energy storage;
- compressing air or other gases for storage, powering air-powered devices or general uses;
- recovering energy from heat in engine exhaust gases or other sources of heat energy (for example, using a system of the type shown in FIG. 11);
- transfer of energy from heat in engine exhaust gases or other sources of heat energy into compressed gas in an engine to improve efficiency of the engine. Where an in-cylinder heat exchanger as described herein is applied to provide pressurized air for combustion in an engine the pressurized air can be much cooler than it would be if compressed adiabatically. Therefore, there is a much greater temperature difference between hot engine exhaust gases and the pressurized air. This temperature difference allows the pressurized air to accept heat energy from the engine exhaust gases.
- facilitating reduced combustion temperatures and thereby reducing harmful emissions such as NOx.
- actively controlling temperature of a gas as it is being compressed or expanded, which can be useful, for example, in refrigeration applications (particularly where a working fluid is changed in phase by the compression or expansion), during chemical processing to prevent unwanted shifts in chemical equilibrium while a gas mixture is changed in pressure and the like.

Interpretation of Terms

Unless the context clearly requires otherwise, throughout the description and the claims:

- "comprise," "comprising," and the like are to be construed in an inclusive sense, as opposed to an exclusive or exhaustive sense; that is to say, in the sense of "including, but not limited to".
- "connected," "coupled," or any variant thereof, means any connection or coupling, either direct or indirect, between two or more elements; the coupling or connection between the elements can be physical, logical, or a combination thereof.
- "herein," "above," "below," and words of similar import, when used to describe this specification shall refer to this specification as a whole and not to any particular portions of this specification.
- "or," in reference to a list of two or more items, covers all of the following interpretations of the word: any of the items in the list, all of the items in the list, and any combination of the items in the list.
- the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a piston, motor, valve, pump, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. Apparatus for compressing or expanding a gas, the apparatus comprising:

a variable-volume chamber comprising first and second walls movable relative to one another to vary a volume of the chamber;

a heat exchanger within the variable-volume chamber, the heat exchanger connected to at least one of the first and second walls and extending toward the other one of the first and second walls, the heat exchanger comprising an internal passage carrying a heat exchange fluid, wherein the heat exchanger has a length that is resiliently changeable to accommodate relative motion of the first and second walls;

wherein the heat exchanger comprises a helical member comprising a plurality of turns wherein the first and second walls are movable apart from one another between a first configuration corresponding to a smaller volume of the variable-volume chamber and a second configuration corresponding to a larger volume of the variable-volume chamber and adjacent turns of the helical member are more closely spaced when the first and second walls are in the first configuration than they are when the first and second walls are in the second configuration.

2. Apparatus according to claim 1 wherein the heat exchanger is compressed between the first and second walls.

3. Apparatus according to claim 1 wherein the heat exchanger is attached to both of the first and second walls.

4. Apparatus according to claim 3 wherein the heat exchanger is expanded between the first and second walls.

5. Apparatus according to claim 3 wherein the heat exchanger has an un-stretched length that is greater than a distance between points of connection of the heat exchanger to the first and second walls when the first and second walls are in the first configuration and less than a distance between the points of connection of the heat exchanger to the first and second walls when the first and second walls are in the second configuration.

6. Apparatus according to claim 1 wherein the helical member comprises a plurality of hollow tubes having square or rectangular cross sections, each of the plurality of tubes shaped into a helical form.

7. Apparatus according to claim 6 wherein an inside diameter of the helical form of one of the tubes is substantially equal to an outside diameter of the helical form of an adjacent one of the tubes.

8. Apparatus according to claim 7 wherein the tubes are affixed together.

9. Apparatus according to claim 1 wherein the heat exchanger comprises a cylindrical central bore and the variable-volume chamber comprises a plug projecting into the bore.

10. Apparatus according to claim 1 wherein: the variable volume chamber is defined between a cylinder head and a piston movable within a cylinder relative to the cylinder head; the cylinder head provides the first wall; and a head of the piston provides the second wall.

11. Apparatus for compressing or expanding a gas, the apparatus comprising:

a variable-volume chamber comprising first and second walls movable relative to one another to vary a volume of the chamber;

a heat exchanger within the variable-volume chamber, the heat exchanger connected to at least one of the first and second walls and extending toward the other one of the first and second walls, the heat exchanger comprising an internal passage carrying a heat exchange fluid;

wherein:

the heat exchanger has a length that is resiliently changeable to accommodate relative motion of the first and second walls;

the variable volume chamber is defined between a cylinder head and a piston movable within a cylinder relative to the cylinder head; the cylinder head provides the first wall; and a head of the piston provides the second wall; and the heat exchanger comprises a helically wound flattened ribbon wherein the internal passage extends along a length of the ribbon.

12. Apparatus according to claim 11 comprising a plurality of separate internal passages extending along the length of the ribbon.

13. Apparatus according to claim 12 comprising a heat exchange fluid input and a heat exchange fluid output in the head wherein the separate internal passages are in fluid connection with one another at a location near the piston such that a fluid path is provided from the heat exchange fluid input, along one or more of the plurality of passages to the location near the piston and back to the heat exchange fluid output through another one or more of the plurality of passages.

14. Apparatus according to claim 13 wherein the ribbon is connected to the cylinder head at a connector comprising a helical ramp portion.

15. Apparatus according to claim 14 wherein the helical ramp portion comprises a plurality of heat exchange fluid passages in fluid communication with the plurality of internal passages of the ribbon.

16. Apparatus according to claim 10 wherein the cylinder head comprises a first heat exchange fluid port in fluid communication with the internal passage.

17. Apparatus according to claim 16 wherein the cylinder head comprises a second heat exchange fluid port in fluid communication with the internal passage such that a heat exchange fluid can flow into the heat exchanger from the first heat exchange fluid port and out of the heat exchanger into the second heat exchange fluid port.

18. Apparatus according to claim 17 comprising a pump connected to flow fluid from the first heat exchange fluid port through the heat exchanger to the second heat exchange fluid port.

19. Apparatus according to claim 16 wherein the piston comprises a second heat exchange fluid port in fluid communication with the internal passage such that a heat exchange fluid can flow into the heat exchanger from the first heat exchange fluid port and out of the heat exchanger into the second heat exchange fluid port.

20. Apparatus according to claim 10 wherein the heat exchanger comprises a cylindrical central bore and the variable-volume chamber comprises a plug projecting into the bore.

21. Apparatus according to claim 20 wherein the plug extends into the bore of the heat exchanger from the piston.

22. Apparatus according to claim 20 wherein the plug extends into the bore of the heat exchanger from the cylinder head.

23. Apparatus according to claim 22 wherein the plug has a length such that the plug extends from the cylinder head to a point where, when the piston is at a top-dead-center position, a distal end of the plug is nearly touching the piston.

24. Apparatus according to claim 20 wherein the plug comprises one or more gas passages and one or more associated valves connected to allow a gas to enter and/or leave the variable-volume chamber.

25. Apparatus according to claim 10 wherein the heat exchanger has a cylindrical form with an outer diameter substantially equal to an inside diameter of the cylinder.

26. Apparatus according to claim 25 comprising a channel extending longitudinally along the cylinder.

27. Apparatus according to claim 26 comprising a gas inlet or outlet opening into the channel.

28. Apparatus according to claim 10 comprising a mechanism connected to drive reciprocation of the piston.

29. Apparatus according to claim 28 wherein the mechanism comprises: a crankshaft coupled to the piston by a connecting rod; a linear actuator; a swash plate, or a rocker arm.

30. Apparatus according to claim 10 wherein the variable-volume chamber is a first variable-volume chamber and the apparatus comprises: a second variable-volume chamber on a side of the piston away from the first variable-volume chamber; and a second heat exchanger within the second variable-volume chamber, the second heat exchanger comprising an internal passage.

31. Apparatus according to claim 30 wherein a rod is connected to the piston and passes through the second variable-volume chamber and the second heat exchanger comprises a helical member that spirals around the rod.

32. Apparatus according to claim 1 comprising first and second heat exchange fluid ports in fluid communication with the internal passage and a pump connected to flow fluid from the first heat exchange fluid port through the internal passage to the second heat exchange fluid port.

33. Apparatus according to claim 32 wherein the first heat exchange fluid port is on the first wall and the second heat exchange fluid port is on the second wall.

34. Apparatus according to claim 32 wherein the first and second fluid exchange ports are on the first wall.

35. Apparatus according to claim 11 wherein the ribbon is arranged in the chamber such that it comprises a plurality of adjacent sections wherein adjacent ones of the sections are pulled apart when the first and second walls move apart and the adjacent ones of the sections are brought together as the first and second walls move together.

36. Apparatus according to claim 1 configured as a gas expander, the apparatus comprising a first valve connected to regulate a flow of a compressed gas into the variable-volume chamber when the variable-volume chamber is in a first configuration having a first volume and a second valve connected to allow gas to exit the variable-volume chamber when the variable-volume chamber is in a second configuration having a second volume greater than the first volume.

37. Apparatus according to claim 1 configured as a gas compressor, the apparatus comprising a first valve connected to allow a gas to enter the variable-volume chamber when the variable-volume chamber is in a first configuration having a first volume and a second valve connected to allow the gas to exit the variable-volume chamber when the variable-volume chamber is in a second configuration having a second volume less than the first volume.

38. Apparatus according to claim 37 wherein the first and second valves comprise check valves.

39. Apparatus according to claim 37 comprising an external heat exchanger and a pump connected to circulate a heat exchange fluid through the internal passage of the heat exchanger and through the external heat exchanger.

40. Apparatus according to claim 1 wherein the internal passage extends helically along the heat exchanger.

41. Apparatus according to claim 1 wherein a wall of the internal passage is textured.

42. A compressor or expander comprising:

a cylinder defining a compression chamber between a reciprocable piston and a cylinder head;

a heat exchanger within the compression chamber, the heat exchanger comprising a coil having one end coupled to the cylinder head and a second end coupled to the piston;

a passage carrying a heat exchange fluid extending along the heat exchanger between the first and second ends;

wherein the heat exchanger comprises a helical member comprising a plurality of turns wherein the first and second walls are movable apart from one another between a first configuration corresponding to a smaller volume of the variable-volume chamber and a second configuration corresponding to a larger volume of the variable-volume chamber and adjacent turns of the helical member are more closely spaced when the first and second walls are in the first configuration than they are when the first and second walls are in the second configuration.

43. A compressor or expander according to claim 42 comprising a pump coupled to pump the heat exchange fluid through the cylinder head into the passage wherein the passage is coupled to discharge into a passage extending though the piston.

44. Apparatus for cooling a gas, the apparatus comprising a gas compressor operable to yield compressed gas and connected to deliver the compressed gas to a gas expander, the gas compressor comprising:

a variable-volume chamber comprising first and second walls movable relative to one another to vary a volume of the chamber;

a heat exchanger within the variable-volume chamber, the heat exchanger connected to at least one of the first and second walls and extending toward the other one of the first and second walls, the heat exchanger comprising an internal passage carrying a heat exchange fluid, and a pump connected to circulate a heat exchange fluid through the heat exchanger to remove heat from the gas being compressed in the compressor;

wherein the heat exchanger has a length that is resiliently changeable to accommodate relative motion of the first and second walls; and wherein the heat exchanger comprises a helical member comprising a plurality of turns wherein the first and second walls are movable apart from one another between a first configuration corresponding to a smaller volume of the variable-volume chamber and a second configuration corresponding to a larger volume of the variable-volume chamber and adjacent turns of the helical member are more closely spaced when the first and second walls are in the first configuration than they are when the first and second walls are in the second configuration.

45. A method for compressing or expanding a gas, the method comprising:

introducing the gas into a variable-volume chamber;

changing a volume of the chamber; and while changing the volume of the chamber, adding heat to the gas in the chamber or extracting heat from the gas in the chamber by passing a heat exchange fluid through an internal passage within a heat exchanger located inside the chamber wherein the heat exchanger comprises a helical member comprising a plurality of turns wherein the first and second walls are movable apart from one another between a first configuration corresponding to a smaller volume of the variable-volume chamber and a second configuration corresponding to a larger volume of the variable-volume chamber and adjacent turns of the helical member are more closely spaced when the first and second walls are in the first configuration than they are when the first and second walls are in the second configuration; and the method comprising changing a length of the heat exchanger to accommodate changes in a dimension of the chamber.

46. A method according to claim 45 wherein changing a length of the heat exchanger comprises elastically stretching the heat exchanger.

47. A method according to claim 45 comprising maintaining a temperature of the gas substantially constant while changing the volume of the chamber.

48. A method according to claim 47 wherein maintaining the temperature of the gas substantially constant comprises regulating a flow of the heat exchange fluid through the internal passage.

49. A method according to claim 47 performed to compress a gas to yield compressed gas, the method further comprising expanding the compressed gas in an adiabatic expander.

50. A method according to claim 47 operated as the compression phase or expansion phase in a Stirling cycle, or Ericson cycle.

* * * * *